US006029311A

United States Patent [19]

Scanni et al.

[11] Patent Number: 6,029,311

[45] Date of Patent: Feb. 29, 2000

[54] VACUUM ASSISTED BROOM

[76] Inventors: Iberio E. Scanni; Nino V. Scanni, both of 5199 Warwickshire Way, Mississauga, Ontario, Canada, L5V 1N5

[21] Appl. No.: 09/034,013

[22] Filed: Mar. 2, 1998

Related U.S. Application Data

[63] Continuation-in-part of application No. 08/196,555, Feb. 15, 1994, Pat. No. 5,722,112, which is a continuation-in-part of application No. 07/942,784, Sep. 10, 1992, abandoned.

[51] Int. Cl.[7] ..... A47L 5/24

[52] U.S. Cl. ..... 15/344; 15/350; 15/369; 15/373; 15/398

[58] Field of Search ..... 15/344, 350, 369, 15/373, 398

[56] References Cited

U.S. PATENT DOCUMENTS

| | | |
|---|---|---|
| 921,669 | 5/1909 | Boegel et al. . |
| 928,982 | 7/1909 | Kindel . |
| 1,971,493 | 8/1934 | Leathers . |
| 2,178,427 | 10/1939 | Lang . |
| 2,180,930 | 11/1939 | Mortensen . |
| 2,236,989 | 4/1941 | Bjorkman . |
| 2,324,111 | 7/1943 | Ross . |
| 2,591,262 | 4/1952 | Humphrey . |
| 2,674,001 | 4/1954 | Abrams et al. . |
| 3,079,626 | 3/1963 | Yonkers et al. . |
| 3,821,831 | 7/1974 | Grover . |
| 4,956,892 | 9/1990 | Fawkes . |
| 5,432,976 | 7/1995 | Alazet . |
| 5,440,782 | 8/1995 | Yamashita . |
| 5,839,158 | 11/1998 | Schupp et al. ..... 15/398 X |

FOREIGN PATENT DOCUMENTS

| | | |
|---|---|---|
| 1102148 | 5/1955 | France . |
| 171745 | 6/1906 | Germany . |
| 165448 | 2/1934 | Switzerland . |

*Primary Examiner*—Chris K. Moore
*Attorney, Agent, or Firm*—Bereskin & Parr

[57] ABSTRACT

A vacuum assisted broom for sweeping floors having a sweeping member, preferably in the form of a plurality of stiff bristles, for bi-directional sweeping of the floor. The sweeping member is operatively mounted within a housing member, which housing member partially encloses the sweeping member within its hollow interior such that the bristles depend from the housing member through a first opening. A handle member is securely attached to the housing member and extends upwardly therefrom. The sweeping member has bristles which are extended such that the broom may be used as a conventional broom, and as a vacuum pick-up. An electrical switch is actuated so as to turn on a suction means that is operatively connected to the interior of the housing member, thus to create a partial vacuum, at the first opening of the housing member. In this manner, the vacuum, assisted broom of the present invention can be used as conventional sweeping broom and also can be used to subsequently vacuum up any dust or dirt swept to a central location by the broom.

7 Claims, 31 Drawing Sheets

VACUUM ASSISTED BROOM

RELATED APPLICATIONS

This application is a Continuation-in-Part application of application Ser. No. 08/196,555 filed Feb. 15, 1994, now U.S. Pat. No. 5,722,122, issued Feb. 15, 1994, which is a Continuation-in-Part of application Ser. No. 07/942,784 filed Sep. 10, 1992, now abandoned.

FIELD OF THE INVENTION

This invention relates to sweeping brooms and also relates to vacuum powered cleaning devices.

BACKGROUND OF THE INVENTION

It is common for floors in buildings, such as houses and offices, to require the removal of debris—such as dirt, dust, and the like—on a regular basis. Further, the removal of randomly spilled debris may be required on an occasional basis. Obviously, the dust or dirt cannot merely be picked up, but must either be vacuumed up, or swept to a localized area of the floor where it can then be picked up in some manner.

Vacuum cleaners are often used to perform the task of removing dust or dirt from a floor because they tend to do a thorough job and because the dust or dirt is immediately removed by the vacuum cleaner, and subsequent picking up of the durst or dirt is not required.

It is not always easy or convenient to vacuum this dust or dirt, however. It is therefore quite common to use a broom to sweep the dust or dirt into a localized area for subsequent pick up. Various types of brooms exist, such as a push broom, or a common bi-directional sweeping broom, among others. The bi-directional type of sweeping broom is the most usual since it is suitable for relatively quick general sweeping of a floor and allows for sweeping against walls, in corners, and so on. Further, these types of brooms are also relatively lightweight and easy to manipulate. Dirt or dust may be easily swept in any direction towards a localized area using mostly manipulation of the broom and minimizing the amount of walking that needs to be done.

Unfortunately, once brooms move dust and dirt to a localized area, they cannot be used to pick up the dirt or dust. Typically, a dust pan is used in conjunction with a broom to pick up the dirt or dust. Dust pans tend to be messy and inconvenient, however. Further, the dust or dirt in the dust pan must be subsequently disposed of elsewhere.

It is also possible to use a vacuum cleaner to vacuum up any dirt swept to a localized area by a broom. Using a vacuum cleaner in this manner, especially a small hand-held vacuum cleaner such as a DUST BUSTER™, appears sensible in some regards in that the vacuuming overcomes the problems of using a dust pan, and is therefore not messy, not overly inconvenient, and does not require subsequent further disposal of the dust or dirt. However, it seems somewhat illogical to use both a broom and a vacuum cleaner to rid a floor of dirt or dust when a broom is typically used because it is inconvenient to use a vacuum cleaner in the first instance.

It is also possible to use a small portable vacuum cleaner, either in the form of an "electric broom" or in the form of a hand-held vacuum, such as a DUST BUSTER™, to clean dust or dirt from a floor. The main problem with these types of vacuum cleaners is that they cannot sweep dust or dirt to a centralized location, even though the name "electric broom" suggests otherwise, and sweeping may sometimes be required.

Further, these small portable vacuum cleaners typically lack a high suction capacity and often rely on various ways of channelling their suction, as will be discussed subsequently.

DESCRIPTION OF THE PRIOR ART

U.S. Pat. No. 3,079,626 to YONKERS et al. discloses a combination electric vacuum cleaner and floor scrubber. Basically, this is a portable "electric broom", at least in its electric vacuum cleaner configuration, that employs an interchangeable vacuum cleaner head element and a floor scrubber head element in order to convert to a floor scrubber. In the electric vacuum cleaner configuration, commonly referred to as an "electric broom", the vacuum cleaner is not configured whatsoever to act as a broom—only as a vacuum cleaner—and such use is not contemplated.

U.S. Pat. No. 4,956,892 to FAWKES discloses a cordless vacuum brush, wherein the vacuum brush has a plurality of soft brush bristles located around an intake in the perimeter of the bottom portion of the brush head. This unit cannot be used as a broom—it is merely a small vacuum cleaner—and such use is not contemplated.

U.S. Pat. No. 1,971,493 to LEATHERS discloses a vacuum cleaner having a head portion with a pivotable central brush. There are front and rear gaps between the brush and the head portion, which gaps permit the passage of air and debris through the vacuum cleaner head. The brush pivots forwardly and rearwardly in conjunction with corresponding rearward and forward movement of the vacuum cleaner head across the surface being vacuumed. In its forward pivoted position, the brush contacts a soft projection at the front of the vacuum cleaner head portion so as to close off the front gap and to open the rear gap wider to allow for maximum air flow. Similarly, in its rearward pivoted position, the brush contacts a soft projection at the rear of the vacuum cleaner head portion so as to close off the rear gap and open the front gap wider to allow for maximum air flow. The brush in this vacuum cleaner is not, however, suitable for sweeping and cannot perform the type of sweeping action that a broom performs, and such use is not contemplated.

U.S. Pat. No. 2,236,989 to BJORKMAN discloses a vacuum cleaner having a head that is somewhat similar to the vacuum cleaner head disclosed in U.S. Pat. No. 1,971,493, in that the brush moves within the vacuum cleaner head to maximize air flow through the head during vacuuming. This brush moves slidably within the vacuum cleaner head as opposed to pivotally. Again, this brush is not suitable for use as a broom, and such use is not contemplated.

U.S. Pat. No. 2,180,930 to MORTENSEN discloses a vacuum cleaner that has another configuration of a moveable brush within the vacuum head. Again, this brush is not suitable for use as a broom, and such use is not contemplated.

SUMMARY OF THE INVENTION

In accordance with one aspect of the present invention, there is provided a vacuum assisted broom for sweeping floors and the like. This broom has a sweeping member, preferably in the form of a plurality of stiff bristles, for sweeping of the floor. The sweeping member is operatively mounted within a housing member, which housing member partially encloses the sweeping member within its hollow interior such that the bristles depend from the housing member through a first opening. A handle member is securely attached to the housing member and extends upwardly therefrom. The bristles of the sweeping member are extended sufficiently that the broom may be used as both a conventional broom and/or a vacuum cleaner. An electrical switch is actuated so as to in turn actuate a suction means that is operatively connected to the interior of the housing member, thus to create a partial vacuum at the first opening of the housing member. In this manner, the vacuum assisted broom of the present invention can be used as conventional sweeping broom and also can be used to subsequently vacuum up any dust or dirt swept to a central location by the broom.

BRIEF DESCRIPTION OF THE DRAWINGS

Embodiments of this invention will now be described by way of example in association with the accompanying drawings in which.

DETAILED DESCRIPTION OF THE PREFERRED EMBODIMENT

Figure 1:
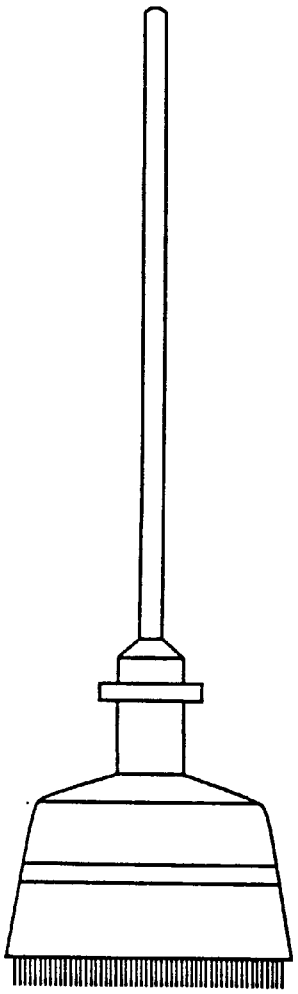
FIG. 1 is a front view of the broom.
Figure 3:
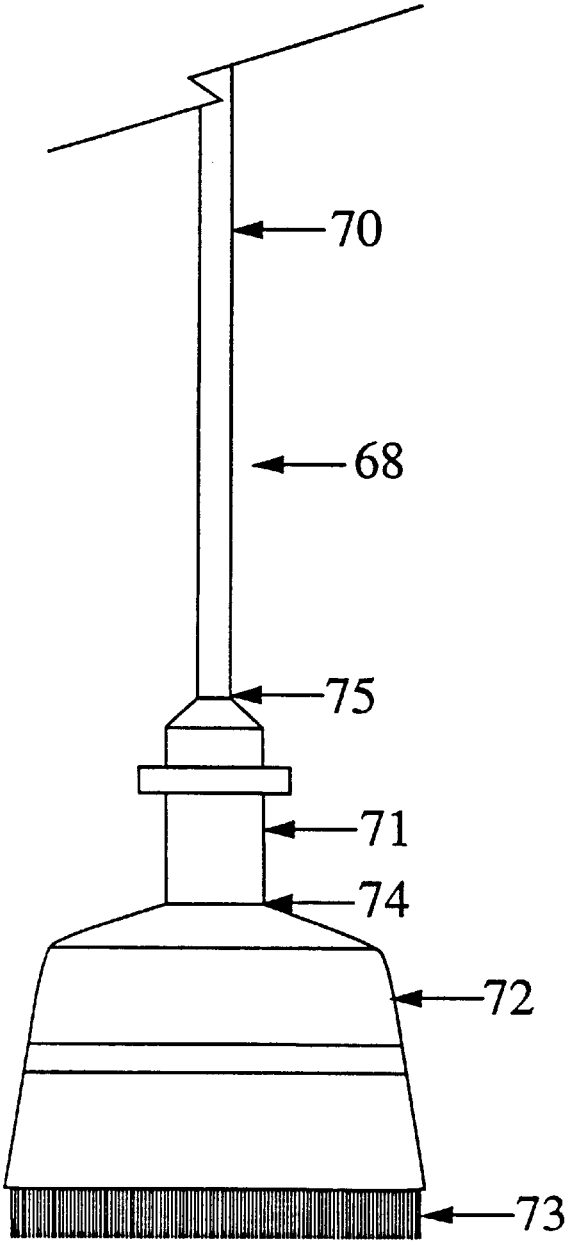
FIG. 3 is an enlarged front view of the broom.
Figure 4:
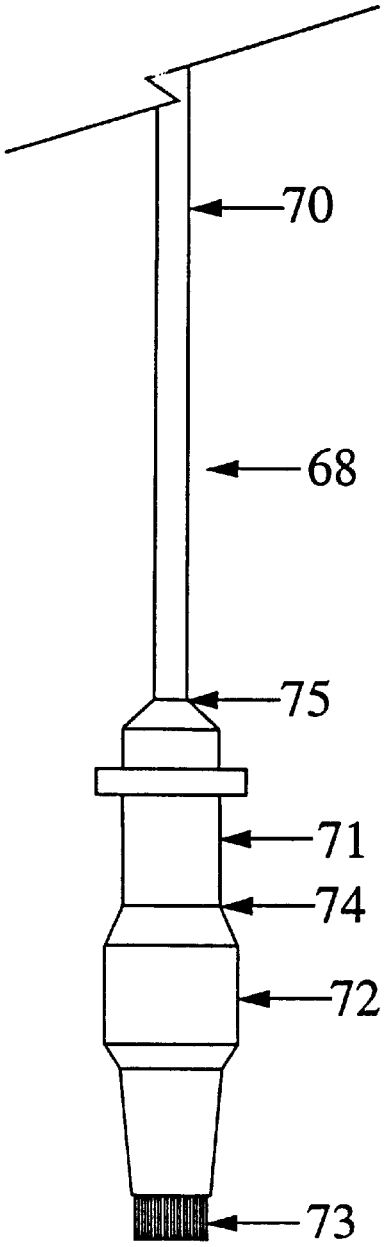
FIG. 4 is a side view of FIG. 3.
Figure 5:
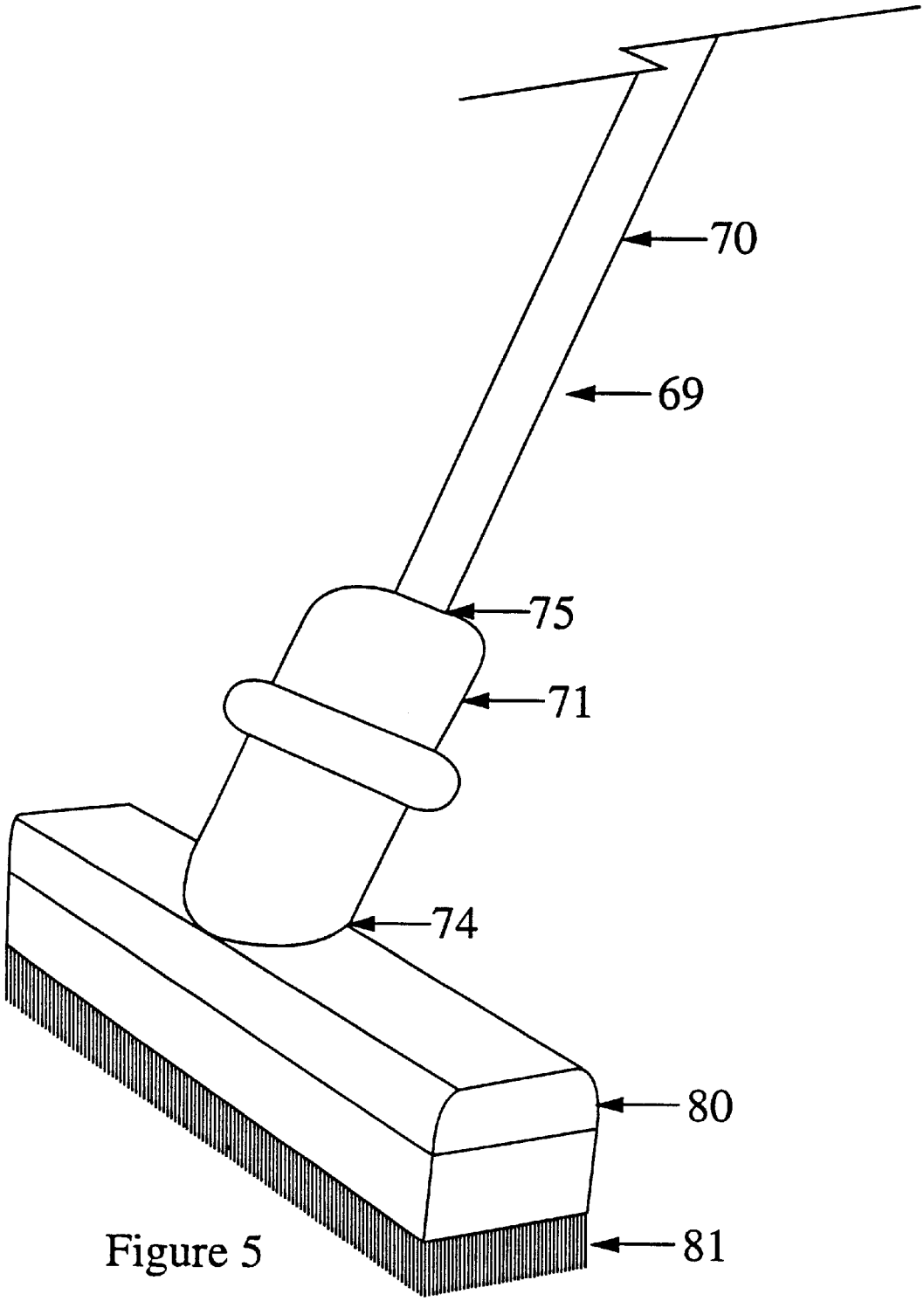
FIG. 5 is an enlarged perspective view of the floor brush.
Figure 6:
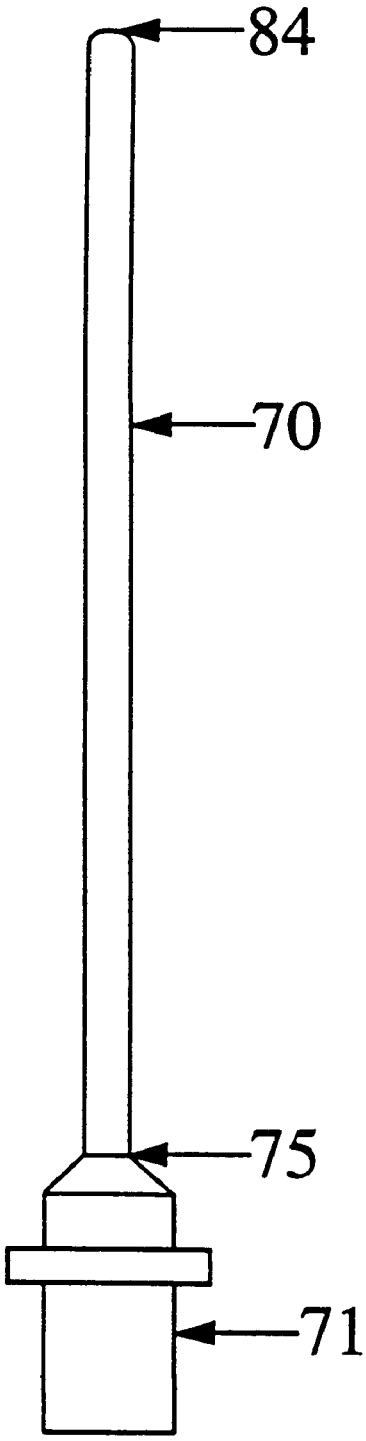
FIG. 6 is a view of a handle with a built-in vacuum producing device with dirt deposit.
Figure 7:
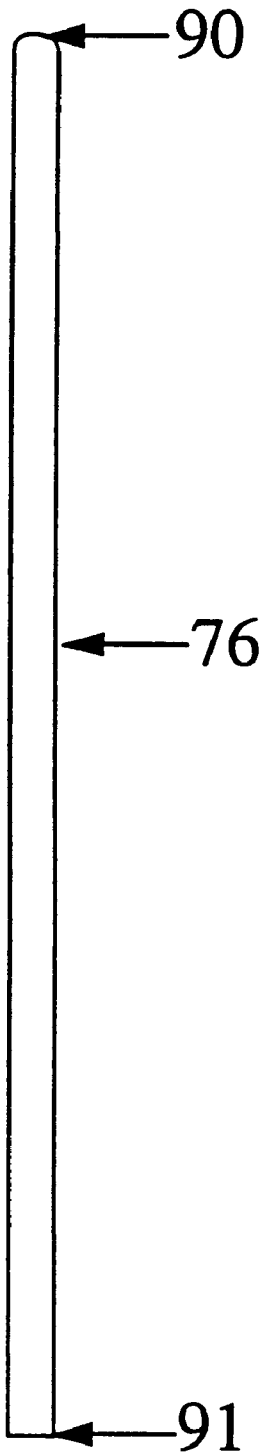
FIG. 7 is a view of a hollow handle that is used with an external vacuum producing device.

Referring to FIGS. 1 to 34, this new vacuum powered broom as seen in FIG. 1 can be made of plastic or any other suitable material. The broom is designated with the number 68 as seen in FIGS. 3 and 4 and generally includes a vacuum assembly 71 defining a forward end 74 and a rearward end 75, a handle assembly 70 secured to end 75 of the vacuum assembly 71 and a brush encasement 72 secured to end 74 of vacuum assembly 71 all of which is operably connected in a well known manner. The brush encasement 72 houses a fixed type brush 86 as seen in FIG. 10 or a movable type brush 87 as seen in FIG. 14. The handle can be of two types. The first type of handle 70, as seen in FIG. 6, consists of a vacuum producing device and dirt deposit 71 whose rearward end 75 is attached to the handle 70. The handle 70, attached to the vacuum producing device 71 at its lower end, is hollow and houses an electrical cable that extends all along the handle to its upper end 84 where a plug in device is located in order to provide the vacuum producing device 71 with electrical power from any conventional 120 volt AC outlet. The handle 70 may also house a rechargeable battery and a battery charger operably connected thereto and securely attached to the sides of the inner wall of the handle 70 to provide the vacuum producing device 71 with electrical power. In both cases an electrical switch is provided on the vacuum producing unit 71. The second type of handle as seen in FIG. 7 and designated 76 is hollow and can accommodate at the top end 90 a detachable hose that connects it to an external vacuum producing device while at the bottom end 91 it is firmly connected to the brush encasement 72 of the broom 68 or to the brush encasement 80 of the floor brush 69.

Figure 9:
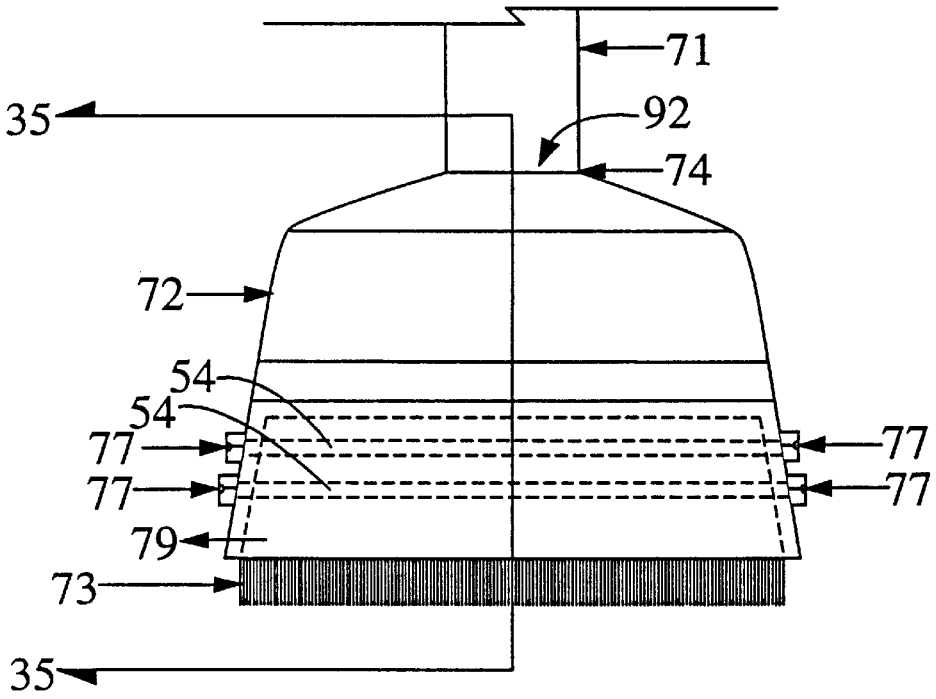
FIG. 9 is a front view of the broom with the fixed brush within the encasement.
Figure 10:
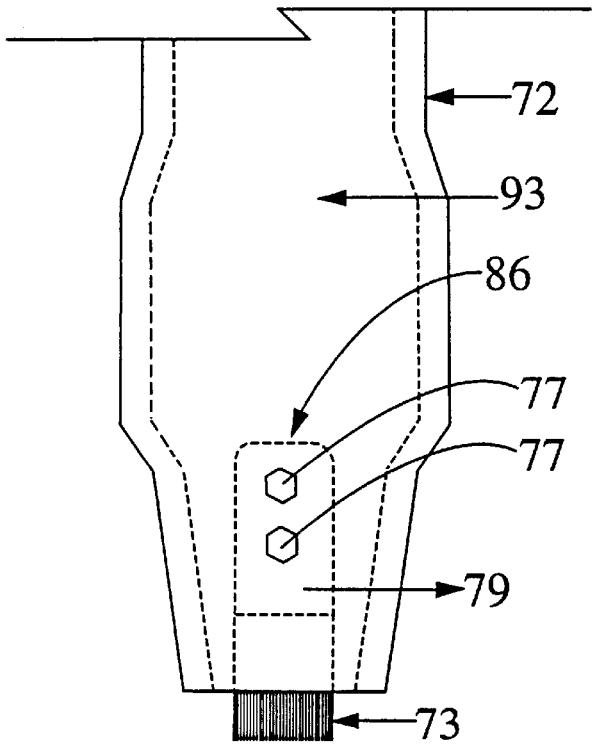
FIG. 10 is a side view of FIG. 9.
Figure 11:
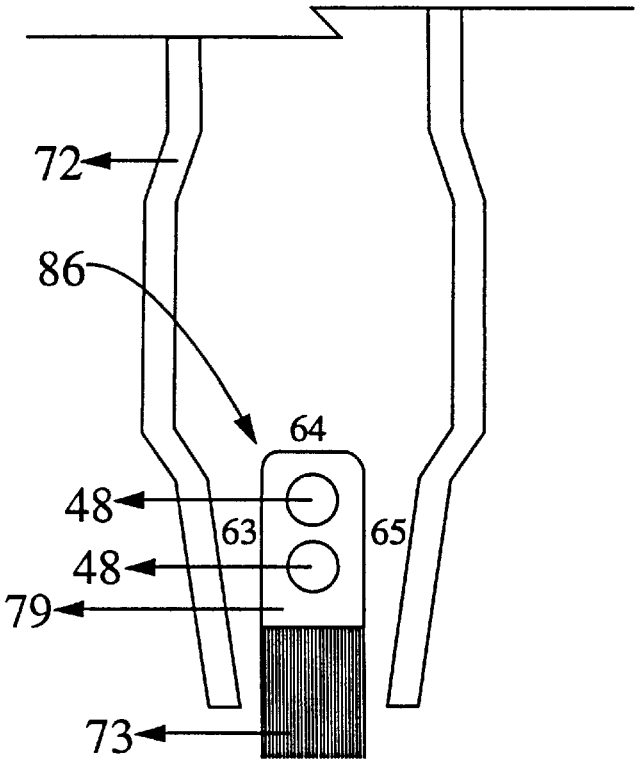
FIG. 11 is a cross-sectional view taken on the line 35—35 of FIG. 9.
Figure 13:
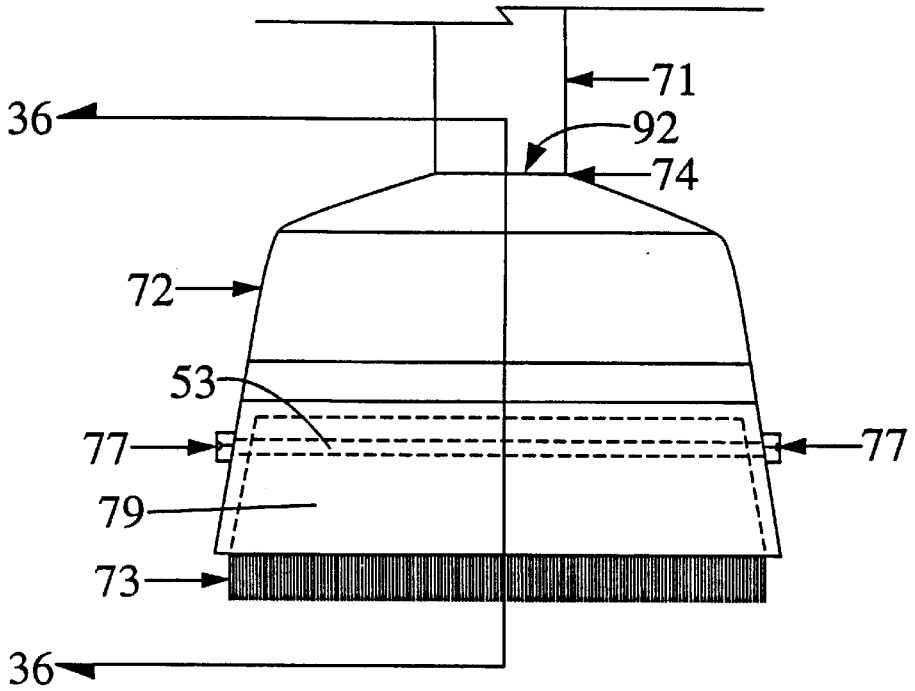
FIG. 13 is a front view of the broom with the movable brush within the encasement.
Figure 14:
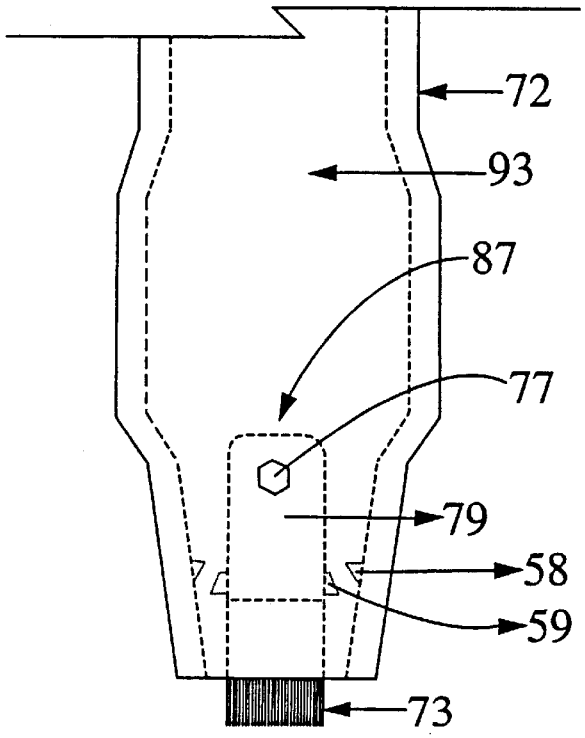
FIG. 14 is a side vie of FIG. 13.
Figure 15:
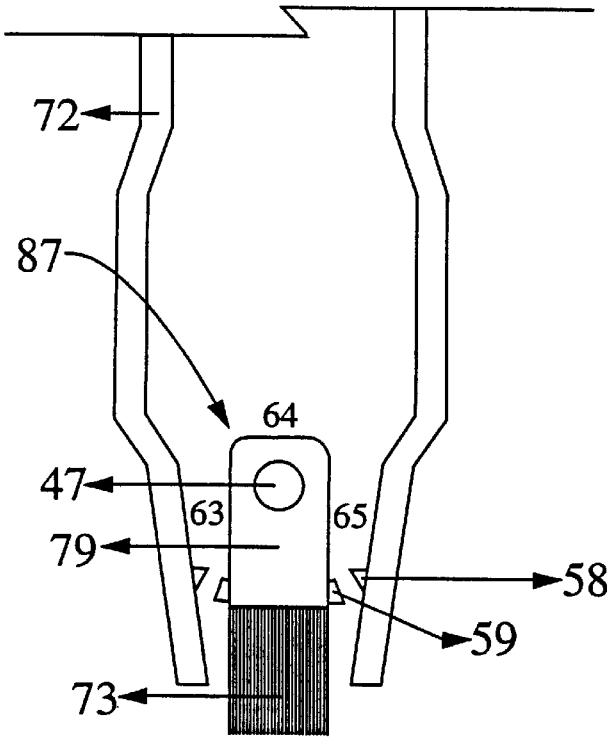
FIG. 15 is a cross-sectional view taken on the line 36—36 of FIG. 13.
Figure 16:
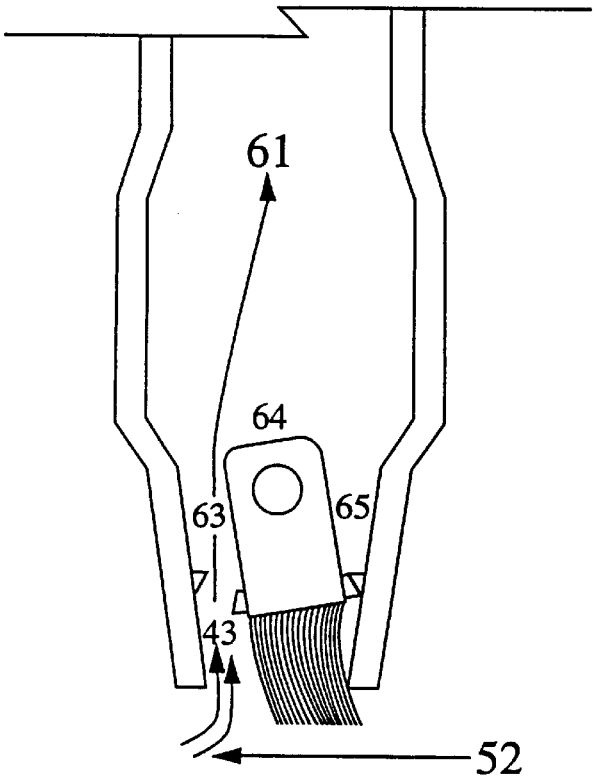
FIG. 16 is a cross-sectional view taken on the line 36—36 of FIG. 13 while in use.

The brush encasement 72 is provided with an outlet 92 as seen in FIGS. 9 and 13 to which is secured the forward end 74 of vacuum assembly 71. The brush encasement 72 has a hollow interior 93 in the shape as illustrated in FIGS. 9, 10, 13 and 14. The brush encasement 72 is open at the bottom where the bristles 73 of the fixed brush assembly 86 or the movable brush assembly 87 protrude through. Mounted within space 93 is the movable type of brush assembly 87 as seen in FIGS. 13 and 14 or the fixed type of brush assembly as seen in FIGS. 9 and 10 all of which is described as follows. The fixed type of brush assembly 86 and the movable type of brush assembly 87 consist of many fine bristles 73 attached to a central rigid body 79 as seen in FIGS. 11 and 15. The movable type of brush assembly 87 as seen in FIGS. 15 and 16 has one hole 47 in its rigid body that transverses the said rigid body. As seen in FIG. 13 the said hole 47 houses a long shaft 53 with threaded ends. The shaft 53 is also inserted through the opposite holes located on each side of the encasement 72 against which it is fastened with nuts 77. All around the rigid body of the movable brush assembly 87, housed in the brush encasement 72, is attached securely a rubber sealing strip 59 as seen in FIG. 14. A rubber sealing strip 58 is securely attached all around the inside of the encasement 72 as seen in FIG. 15 in such a manner that when the movable brush assembly 87 pivots over the shaft 53, during the sweeping action, the two rubber sealing strips 58 and 59 meet and press against each other. Both rubber sealing strips work together as shown in FIG. 16 in order to seal the suction chamber opposite to the direction of sweeping. When the sweeping action is in the direction indicated by arrow 52, suction chamber 63 opens all the way and suction chamber 65 is sealed as seen in FIG. 16. The sealing action of the rubber strips 58 and 59 maintains a higher vacuum gradient on the side currently in use. In FIGS. 15 and 16 number 43 represents the dust being collected, 61 the direction of the vacuum power being applied, 79 the rigid body of the brush assembly, 47 the pivot hole for the brush assembly and 73 the bristles. Also, in the same figures, 63 and 65 represent the two working suction chambers of the broom 68 while 64 represents the upper portion of the brush where the dirt and dust flows through.

Figure 12:
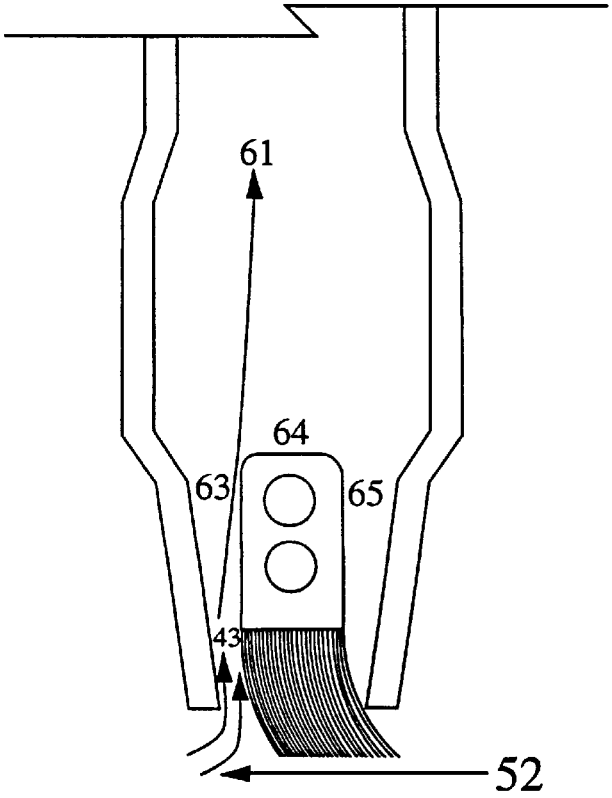
FIG. 12 is a cross-sectional view taken on the line 35—35 of FIG. 9 while in use.

The fixed type of brush assembly 86 as seen in FIGS. 11 and 12 has two holes 48 in its rigid body 79 that transverse the said rigid body. As seen in FIG. 9 the said holes 48 house two long pins 54 with threaded ends. The pins 54 are also inserted through the opposite holes located on each side of the encasement 72 against which they are fastened with nuts 77. In the fixed type of brush assembly 86 the sealing action of suction chambers 63 or 65 is performed by the bristles 73 which bend and press against the bottom of the brush encasement 72 in the direction opposite to the sweeping motion 52 as seen in FIG. 12. In the fixed type of brush assembly 86, the principle of operation is the same as was previously indicated for the movable type of brush assembly 87.

Figure 2:
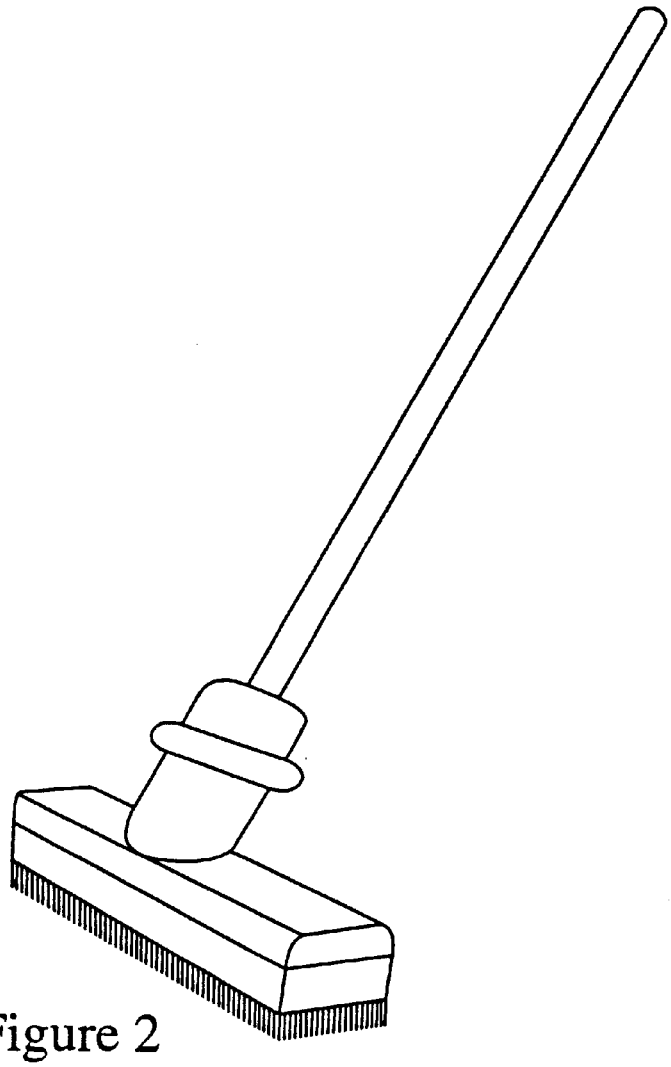
FIG. 2 is a perspective view of a floor brush.
Figure 8:
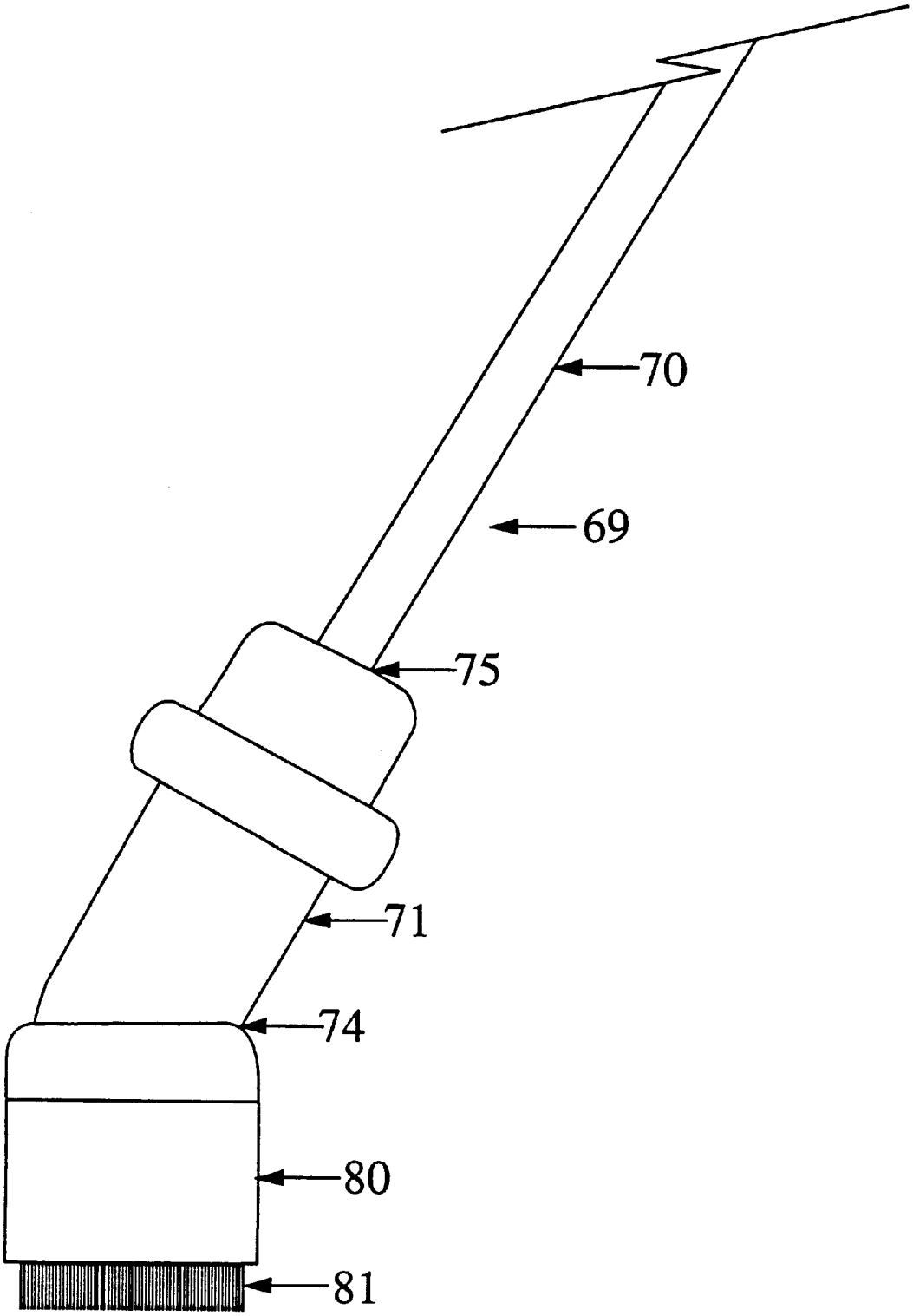
FIG. 8 is a side view of FIG. 5.
Figure 20:
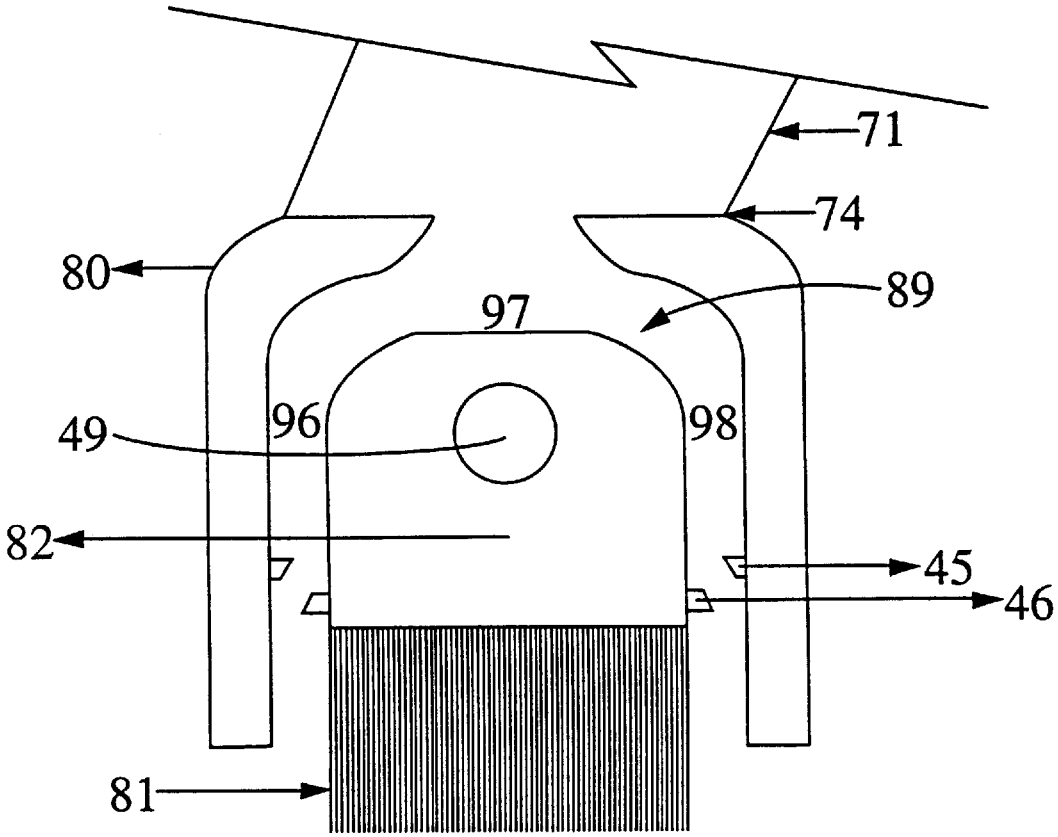
FIG. 20 is a cross-sectional view on the line 37—37 of FIG. 17 while at rest.
Figure 21:
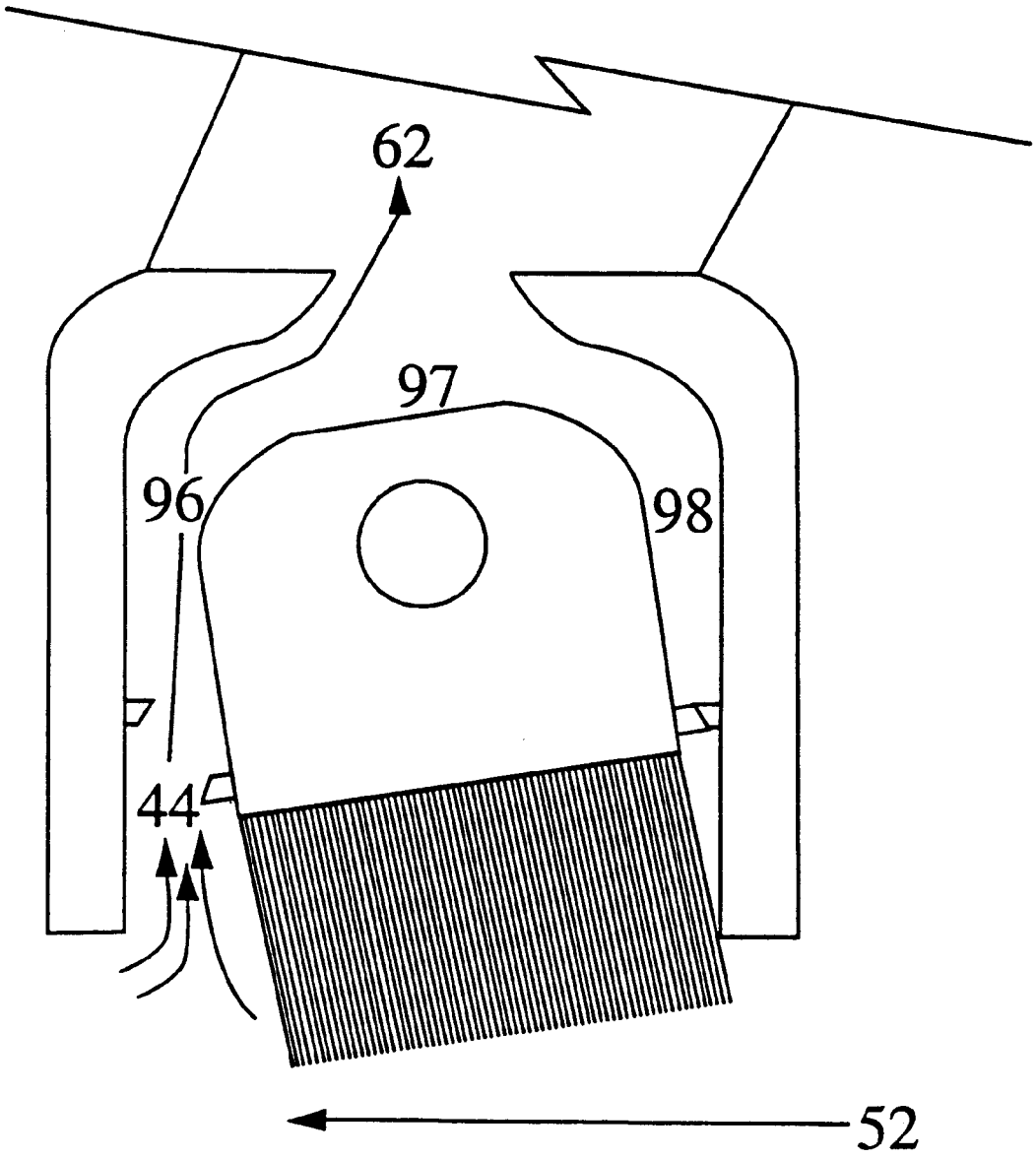
FIG. 21 is a cross-sectional view on the line 37—37 of FIG. 17 while in use.
Figure 22:
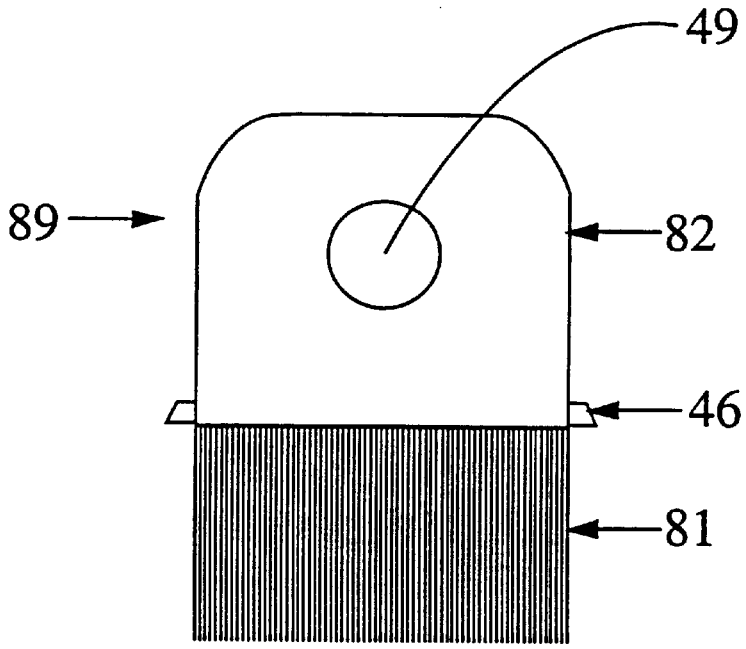
FIG. 22 is a detailed side view of the movable brush.
Figure 23:
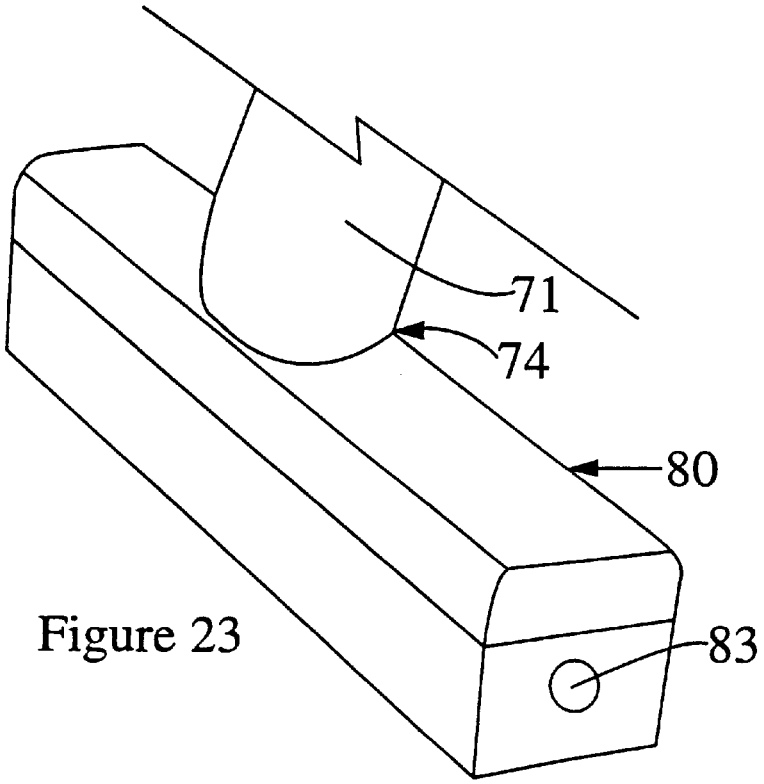
FIG. 23 is a perspective view of the movable floor brush encasement.
Figure 24:
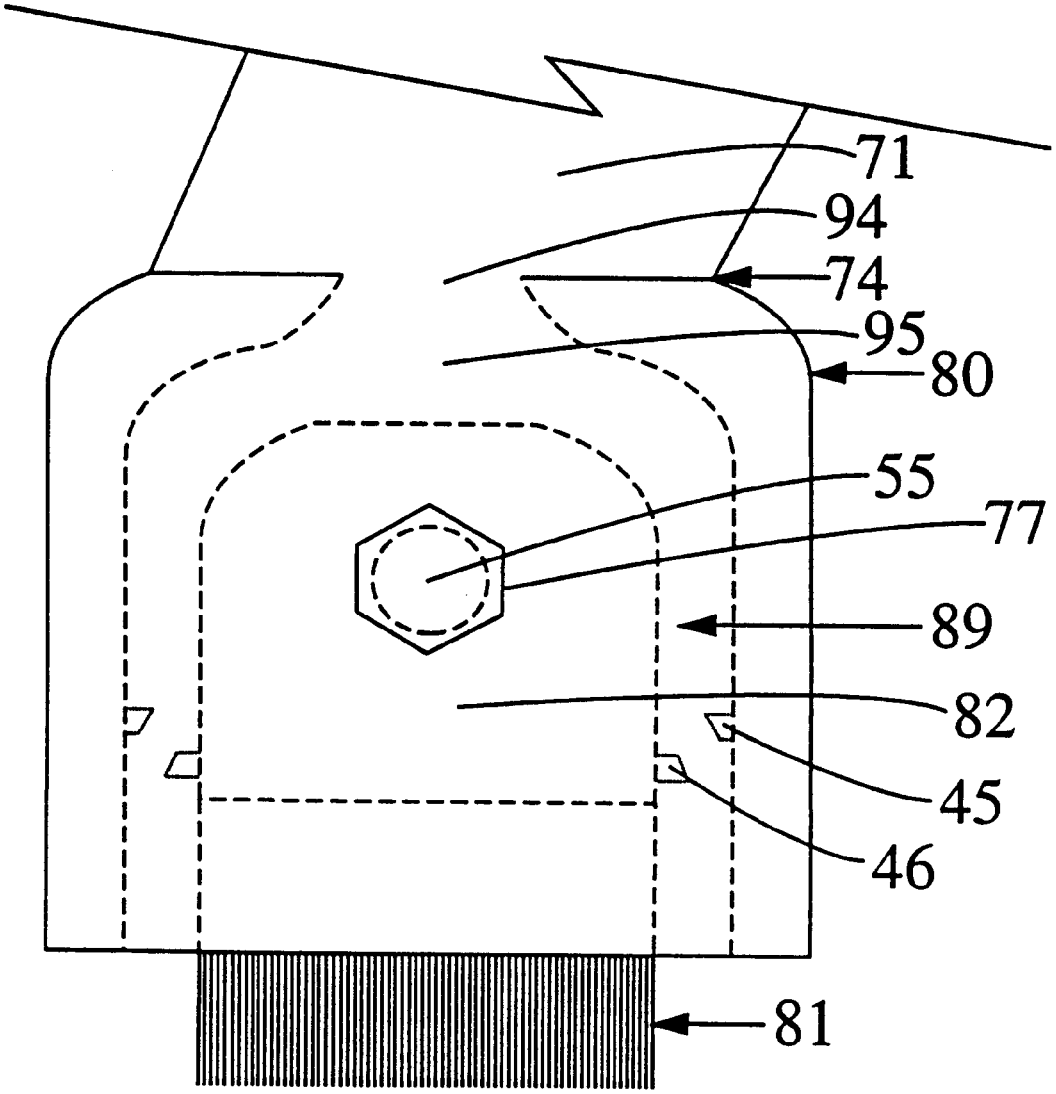
FIG. 24 is a side view of the movable brush assembly and case at rest.
Figure 25:
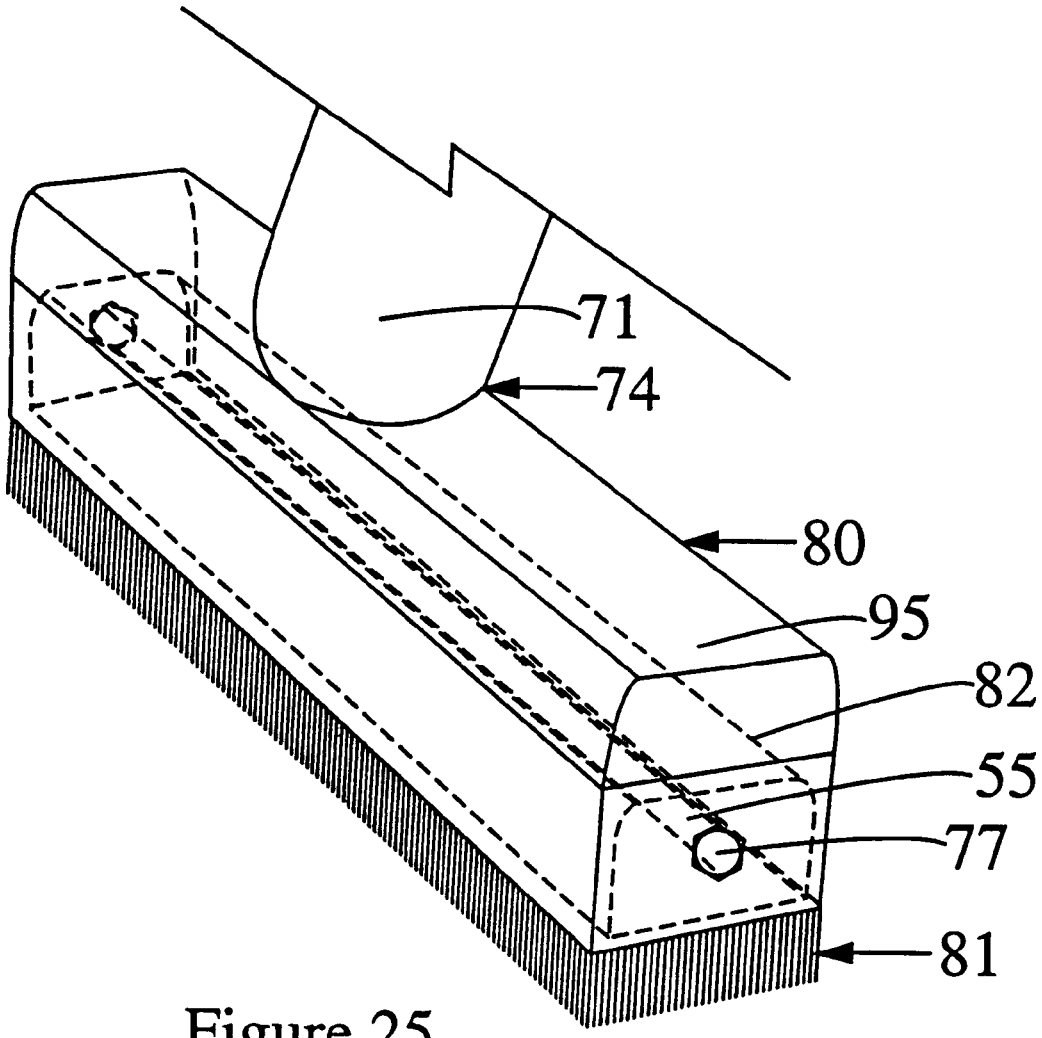
FIG. 25 is a perspective view of FIG. 24.
Figure 26:
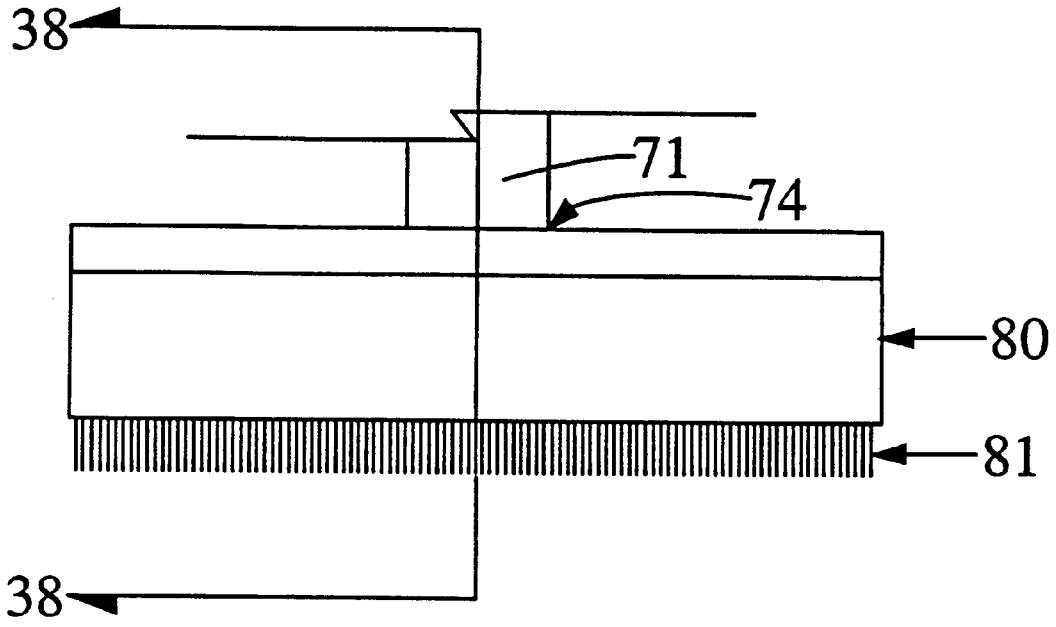
FIG. 26 is a front view of the fixed floor brush.
Figure 27:
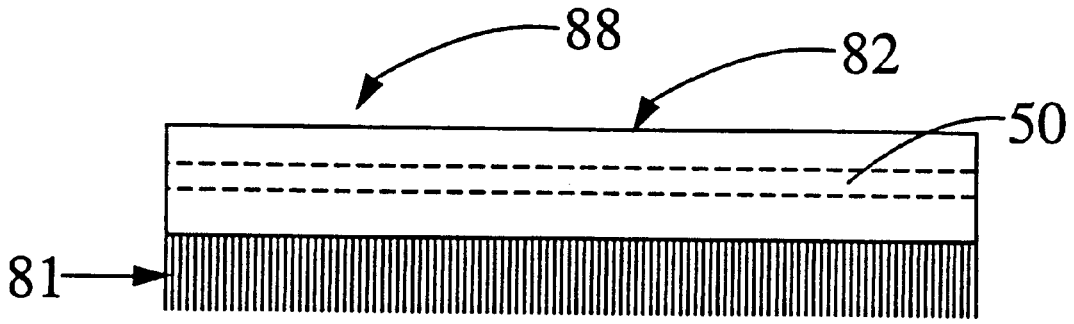
FIG. 27 is a front view of the fixed brush in FIG. 26.
Figure 28:
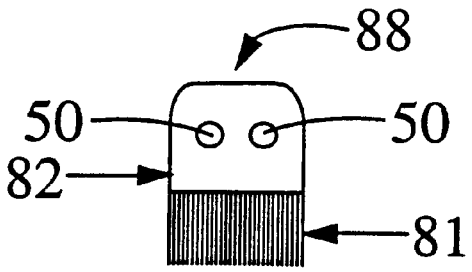
FIG. 28 is a side view of FIG. 27.
Figure 29:
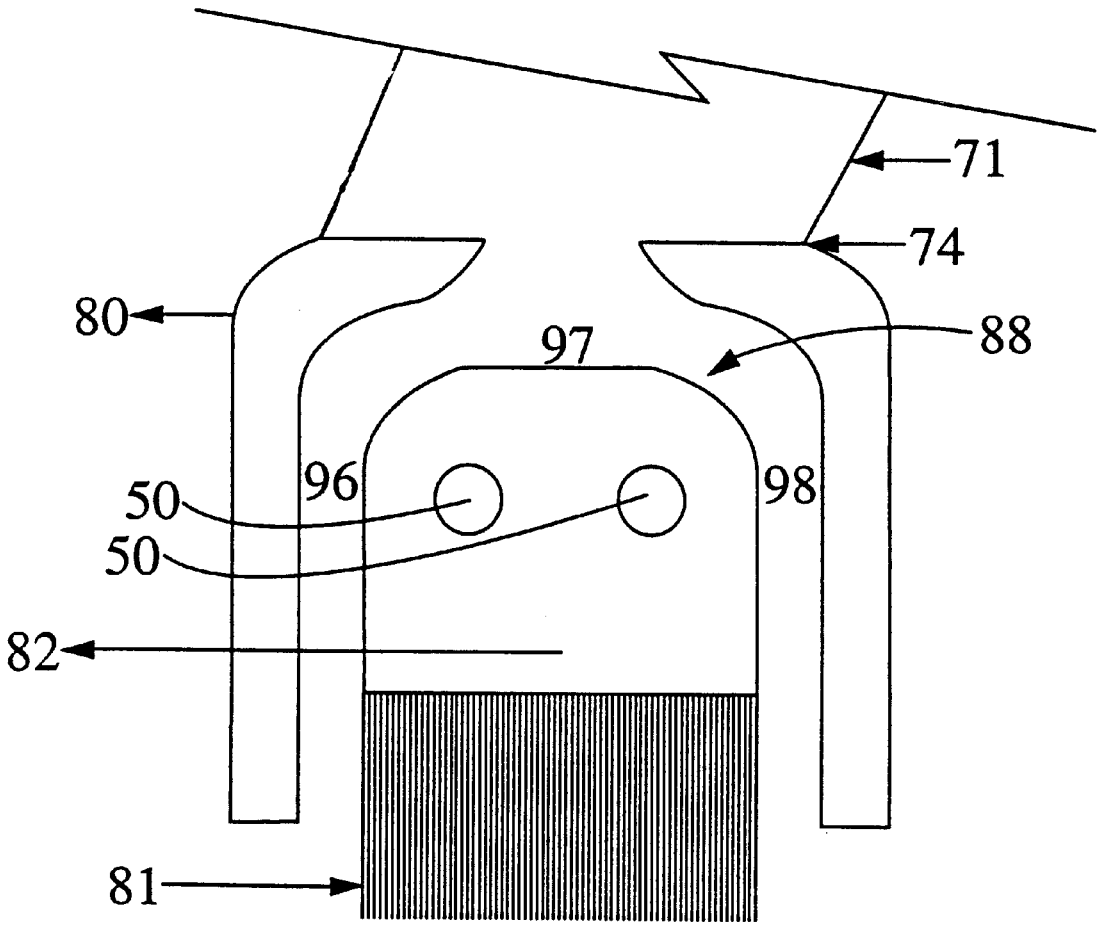
FIG. 29 is a cross-sectional view on the line 38—38 of FIG. 26 while at rest.
Figure 33:
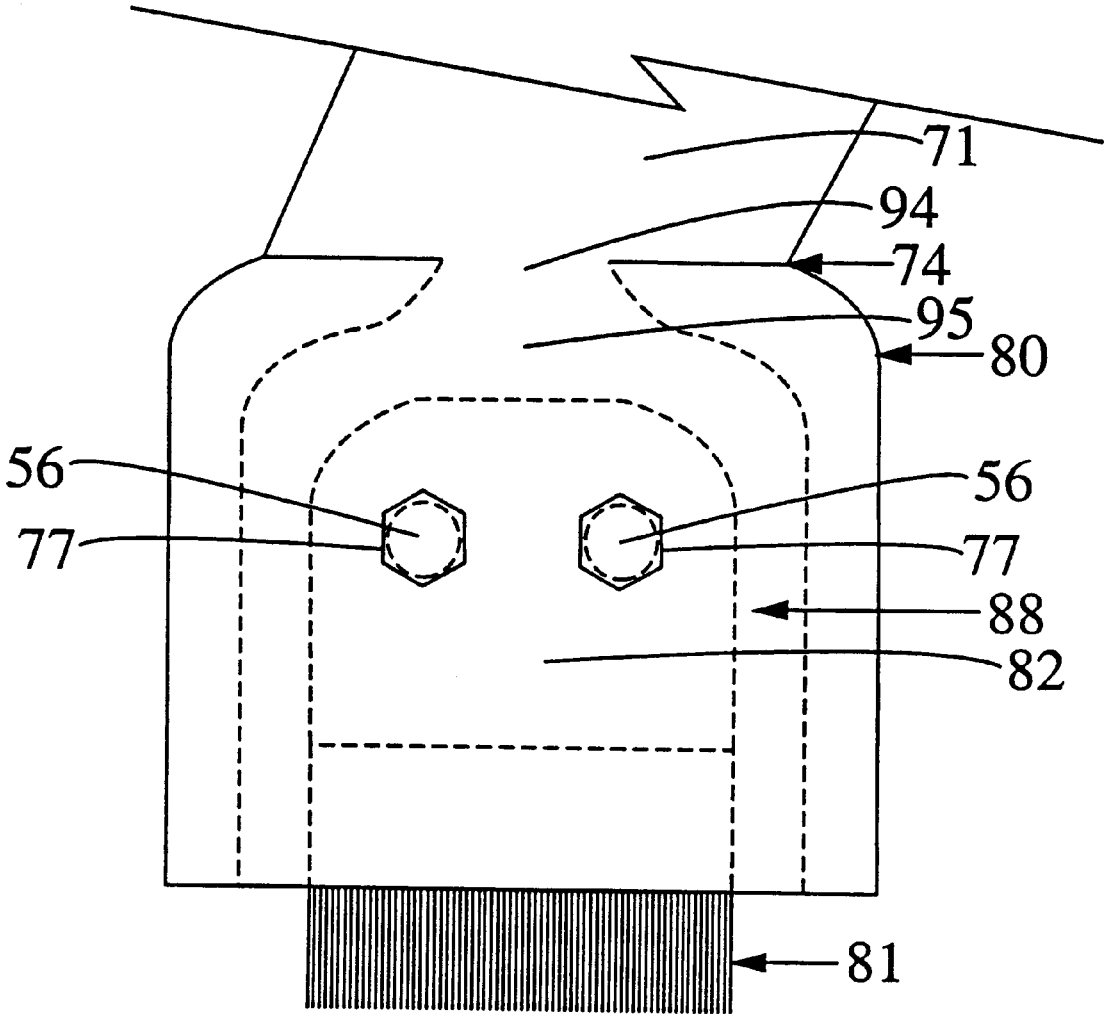
FIG. 33 is a side view of the fixed brush assembly and case at rest.

Referring to the drawings, the vacuum powered floor brush as seen in FIG. 2 can be made of plastic or any other suitable material. The floor brush is designated with the number 69 as seen in FIGS. 5 and 8 and generally includes a vacuum assembly 71 defining a forward end 74 and a rearward end 75, a handle assembly 70 secured to end 75 of the vacuum assembly 71 and a brush encasement 80 secured to end 74 of the vacuum assembly 71 all of which is operably connected in a well known manner. The brush encasement may house a movable type of brush 89 as seen in FIG. 20 or a fixed type of brush 88 as seen in FIG. 29. The two types of handles 70 and 76 seen in FIGS. 6 and 7 respectively that can be used with the broom 68, as previously described, can also be used with the floor brush 69. The brush encasement 80 is provided with an outlet 94 as seen in FIGS. 24 and 33 to which is secured the forward end 74 of vacuum assembly 71. The brush encasement 80 has a hollow interior 95 in the shape as illustrated in FIGS. 24, 25, 33 and 34. The brush encasement 80 is open at the bottom where the bristles 81 of the fixed brush assembly 88 or the movable brush assembly 89 protrude through. Mounted within space 95 is the movable type of brush assembly 89 as seen in FIG. 24 or the fixed type of brush assembly 88 as seen in FIG. 33 all of which is described as follows. The movable type of brush assembly 89 and the fixed type of brush assembly 88 consist of many fine bristles 81 attached to a central rigid body; 82 as seen in FIGS. 20 and 29. The movable type of brush assembly 89 as seen in FIGS. 17, 18, 19, 20, 21 and 22 has one hole 49 in its rigid body that transverses the said rigid body. As seen in FIG. 25, the said hole 49 houses a long shaft 55 with threaded ends. The shaft 55 is also inserted through the opposite holes 83 located on each side of the encasement 80, as seen in FIG. 23, against which they are fastened with nuts 77 as seen in FIG. 25. All around the rigid body of the movable brush assembly 89, housed in the brush encasement 80, is attached securely a rubber sealing strip 46 as seen in FIGS. 18, 19, 20 and 22. A rubber sealing strip 45 is securely attached all around the inside of the encasement 80 as seen in FIG. 20 in such a manner that when the movable brush assembly 89 pivots over the shaft 55, during the sweeping action, the two rubber sealing strips 45 and 46 meet and press against each other. Both rubber sealing strips work together as shown in FIG. 21 in order to seal the suction chamber opposite to the direction of sweeping. When the sweeping action is in the direction indicated by arrow 52, suction chamber 96 opens all the way and suction chamber 98 is sealed as seen in FIG. 21. The sealing action of the rubber strips 45 and 46 maintains a higher vacuum gradient on the side currently in use. In FIGS. 20 and 21 number 44 represents the dust being collected, 62 the direction of the vacuum power being applied, 82 the rigid body of the brush assembly, 49 the pivot hole for the brush assembly and 81 the bristles. Also, in the same figures, 96 and 98 represent the two working suction chambers of the floor brush 69 while 97 represents the upper portion of the brush where the dirt and dust flows through.

Figure 30:
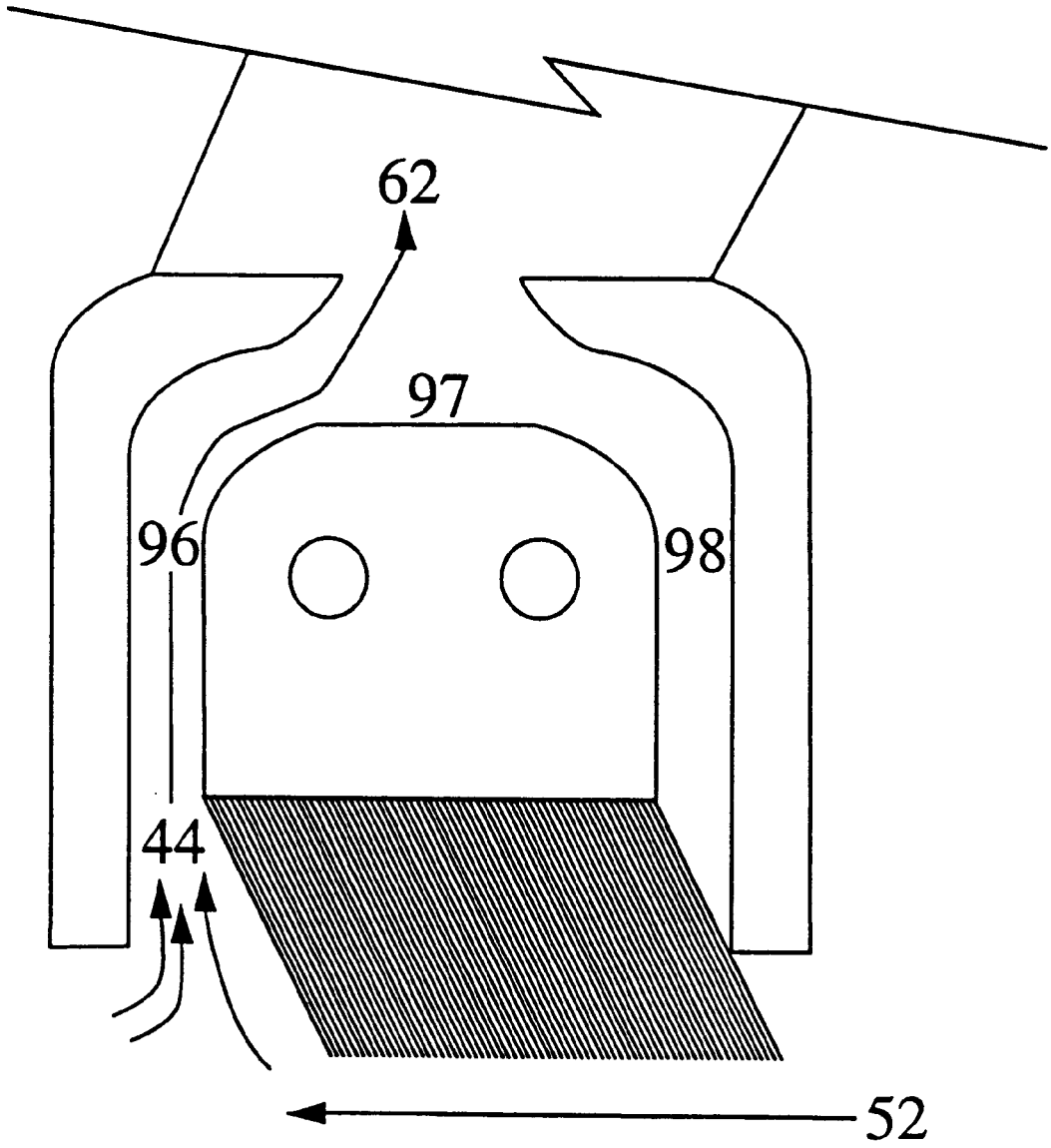
FIG. 30 is a cross-sectional view on the line 38—38 of FIG. 26 while in use.
Figure 31:
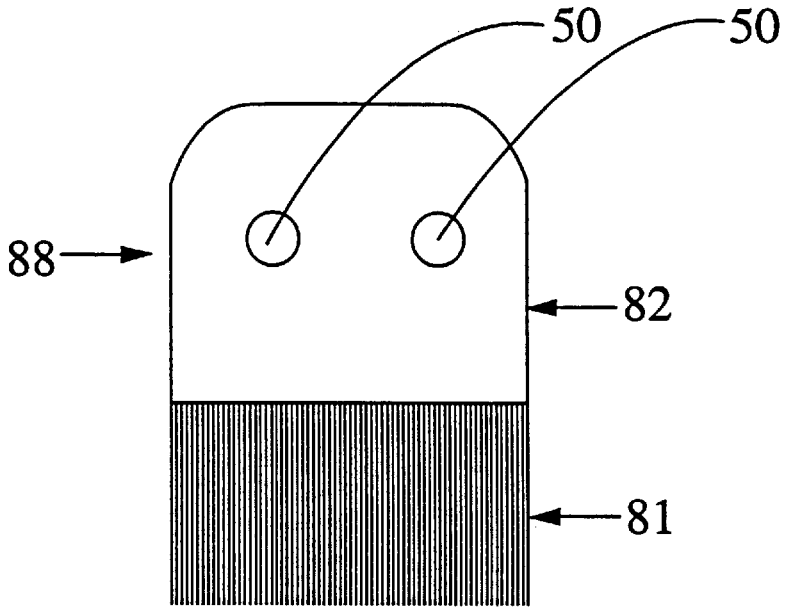
FIG. 31 is a detailed side view of the fixed brush.
Figure 32:
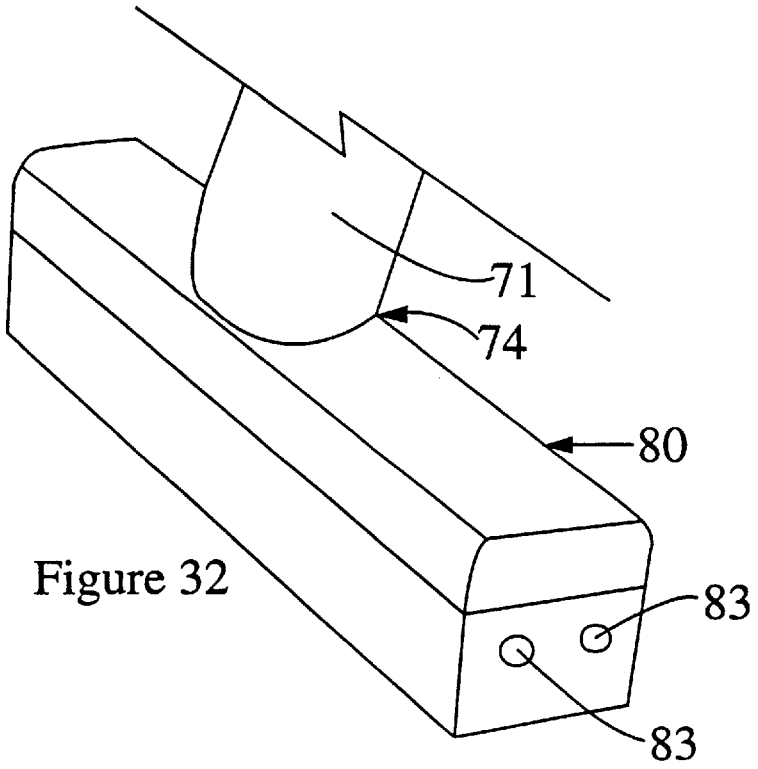
FIG. 32 is a perspective view of the fixed floor brush encasement.
Figure 34:
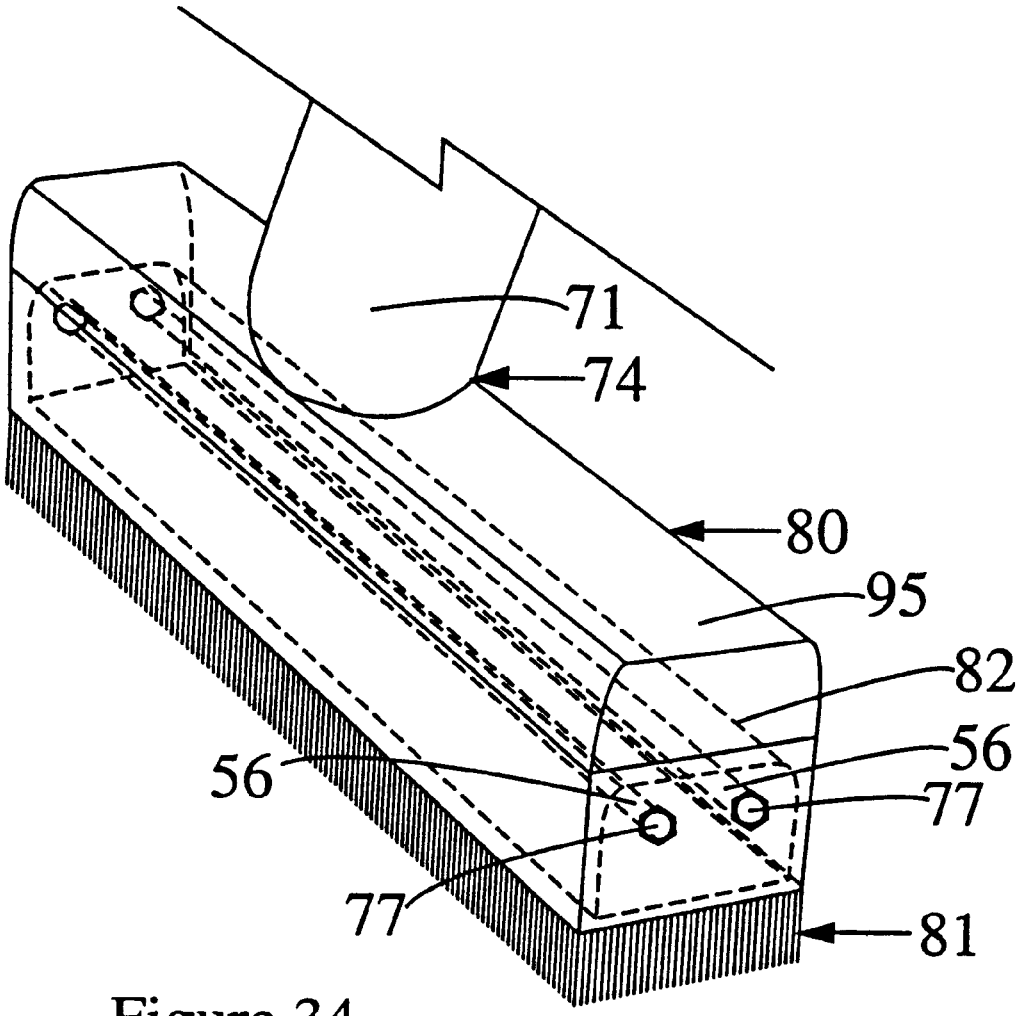
FIG. 34 is a perspective view of FIG. 33.
Figure 35:
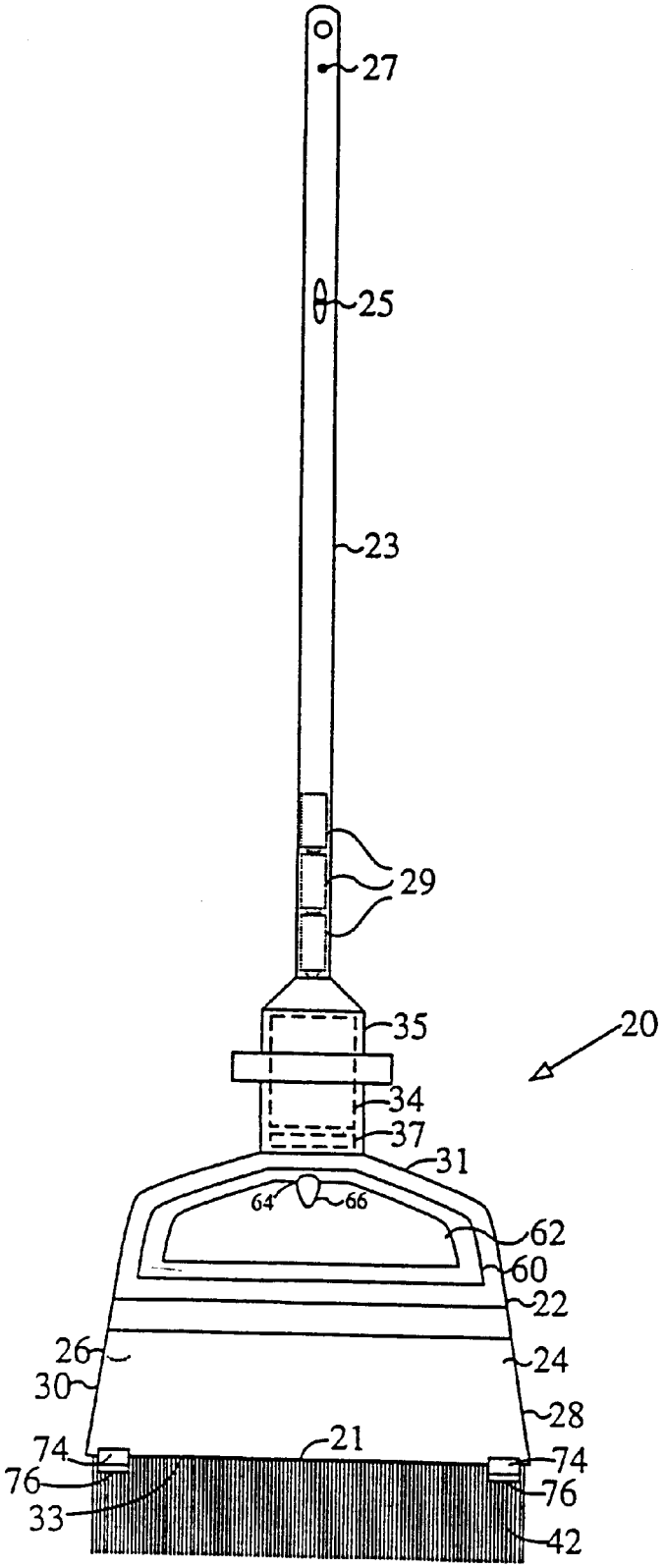
FIG. 35 is a front elevational view of the vacuum assisted broom of the present invention, with the bristles in their extended position.
Figure 36:
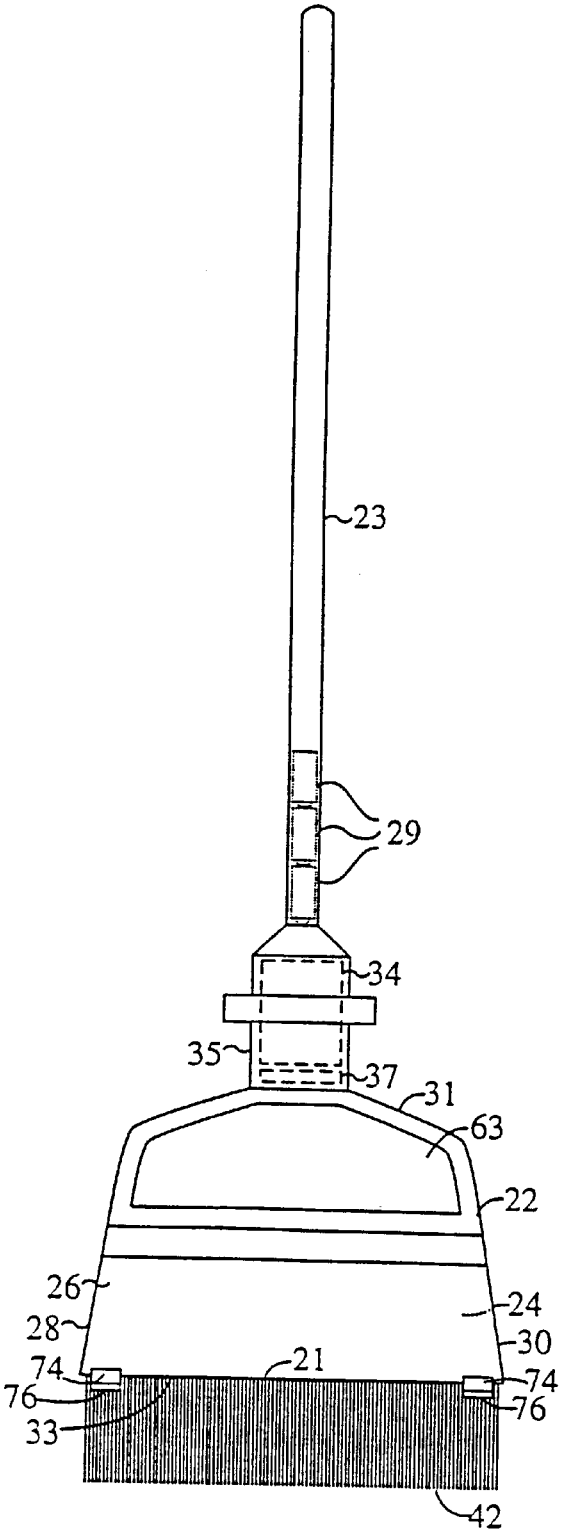
FIG. 36 is a rear elevational view of the vacuum assisted broom as shown in FIG. 35.
Figure 37:
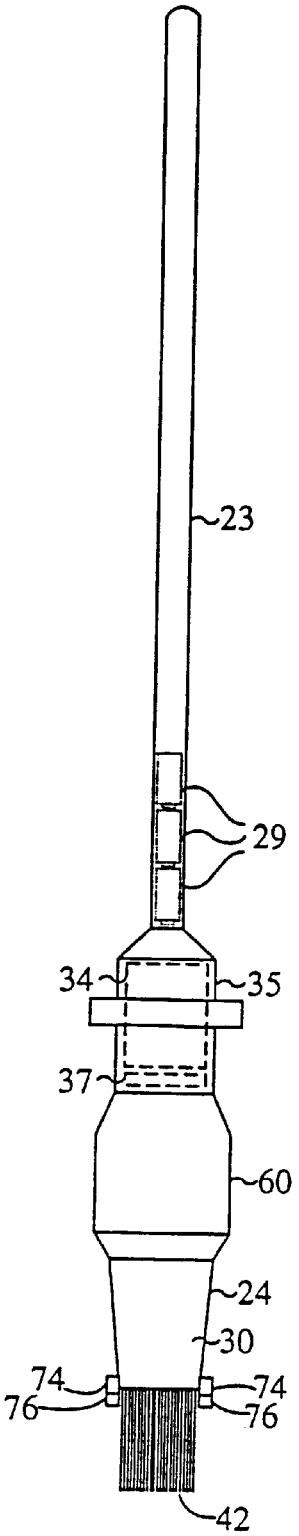
FIG. 37 is a side elevational view of the vacuum assisted broom as shown in FIG. 35.
Figure 38:
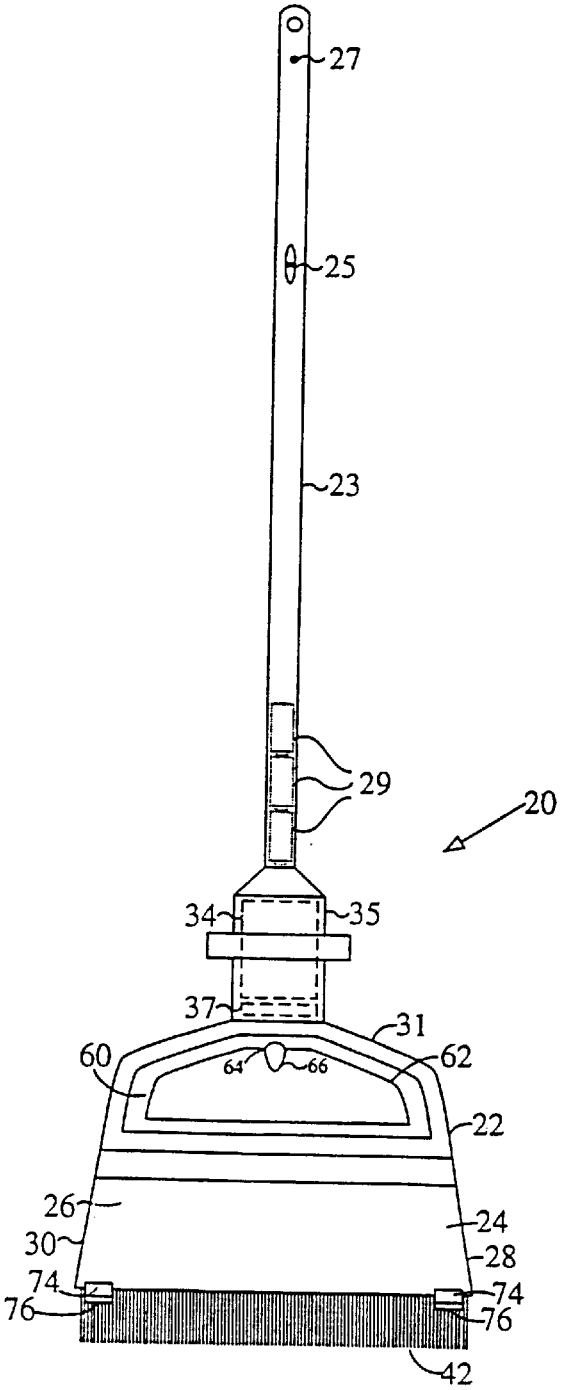
FIG. 38 is a front elevational view of the vacuum assisted broom as shown in FIG. 35, except with the bristles in their retracted position.
Figure 39:
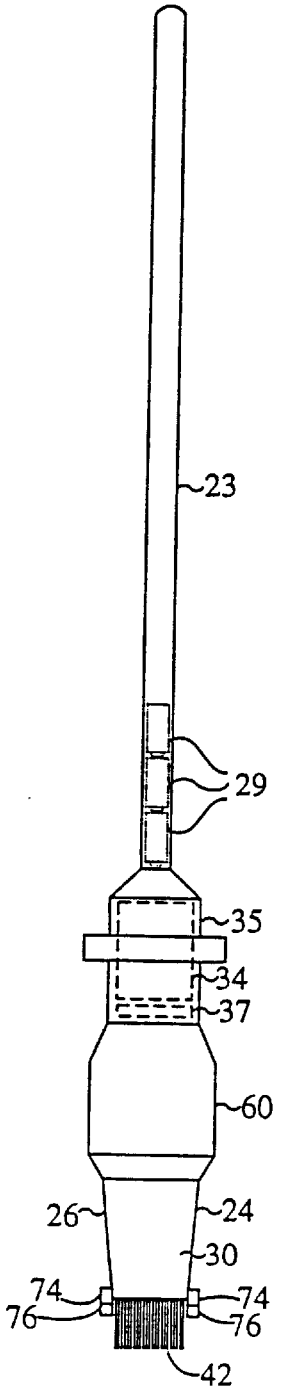
FIG. 39 is a rear elevational view of the vacuum assisted broom as shown in FIG. 38.
Figure 40:
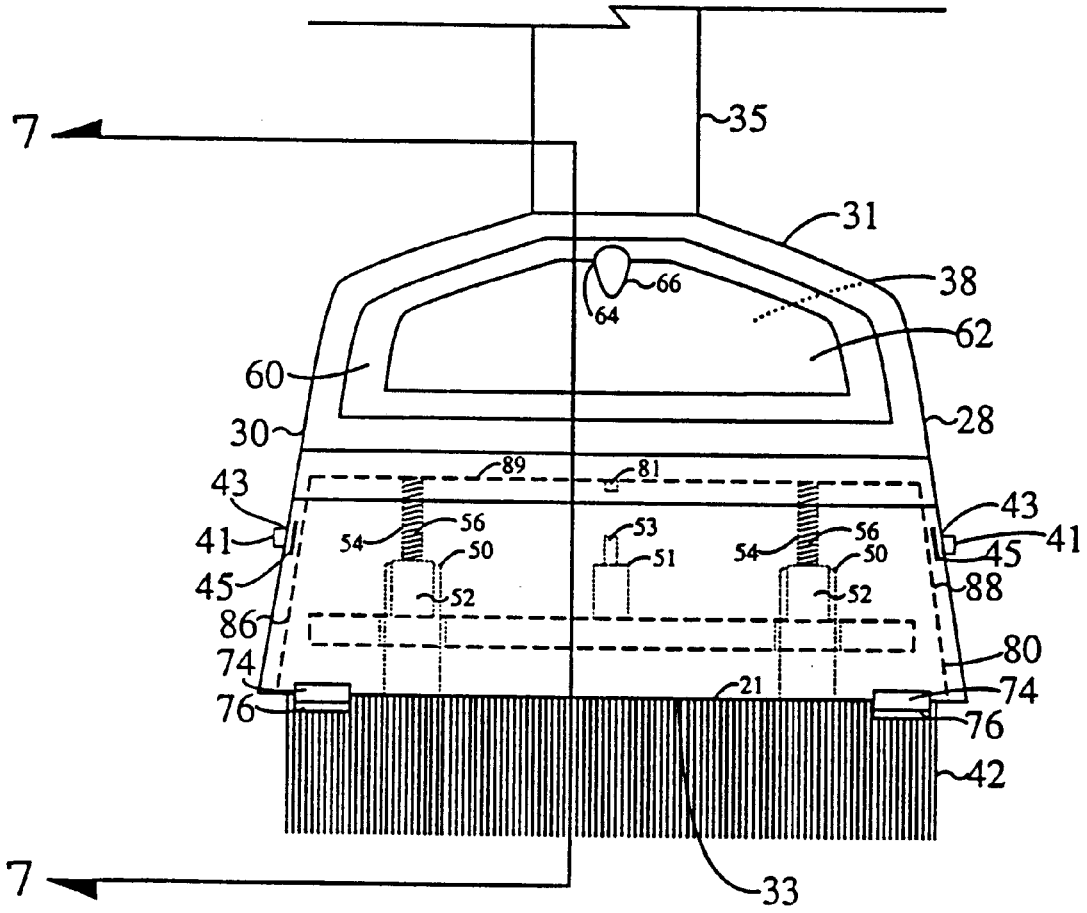
FIG. 40 is a side elevational view of the vacuum assisted broom as shown in FIG. 38.
Figure 41:
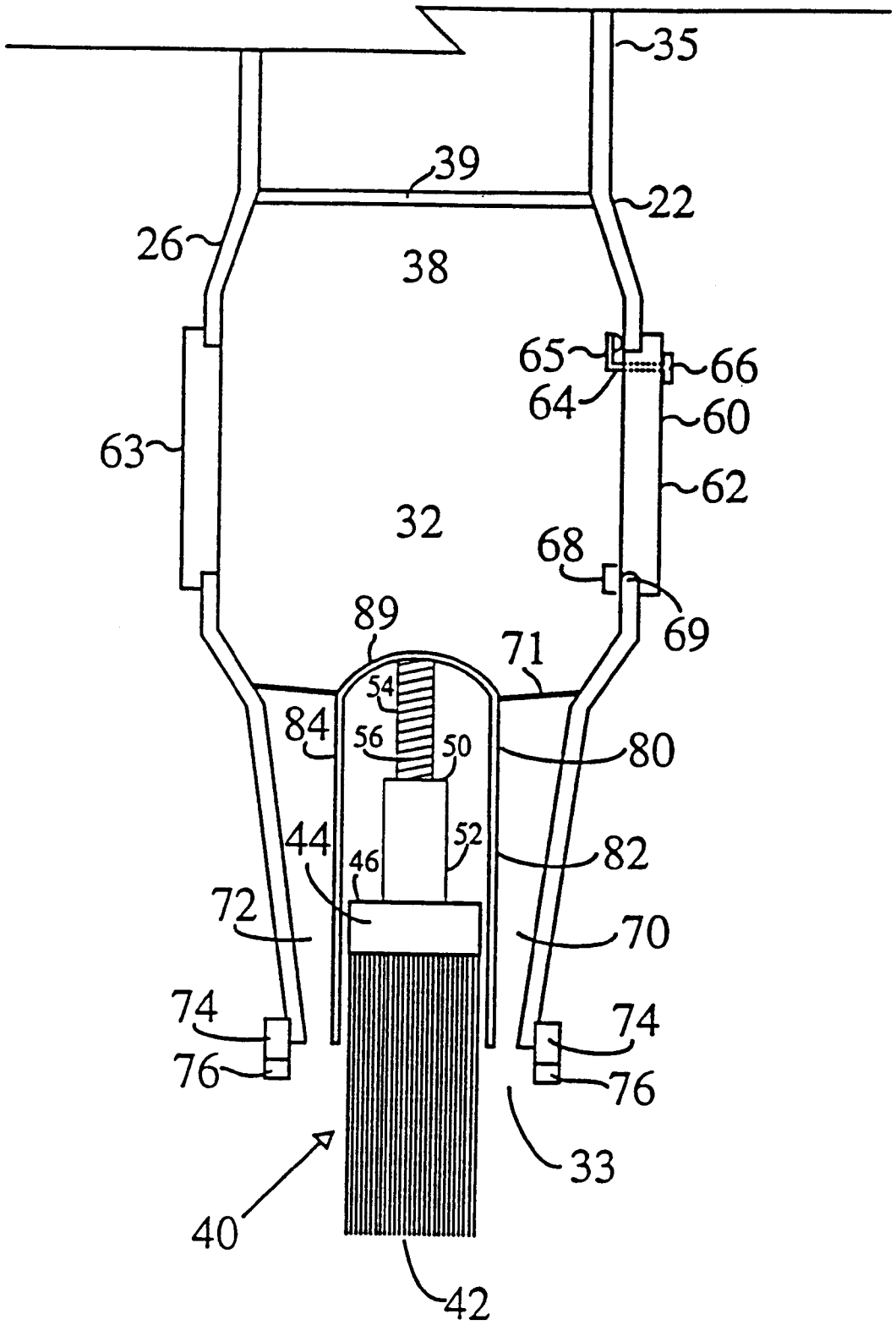
FIG. 41 is an enlarged front elevational view of the head portion of the vacuum assisted broom as shown in FIG. 35.
Figure 42:
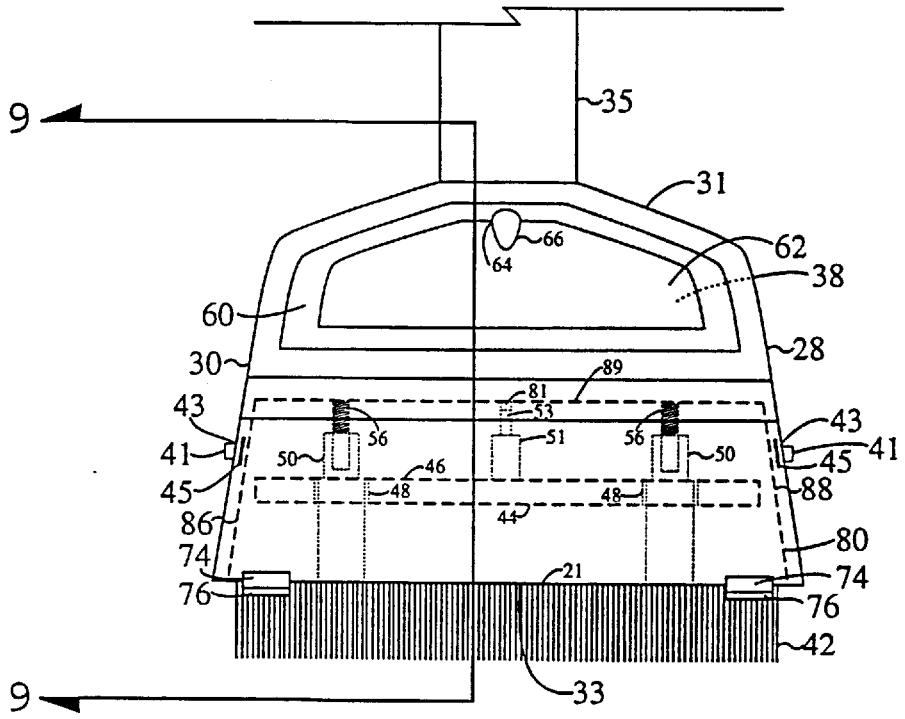
FIG. 42 is a sectional side view along section line 8—8, of the head portion of the vacuum assisted broom, as shown in FIG. 41.
Figure 43:
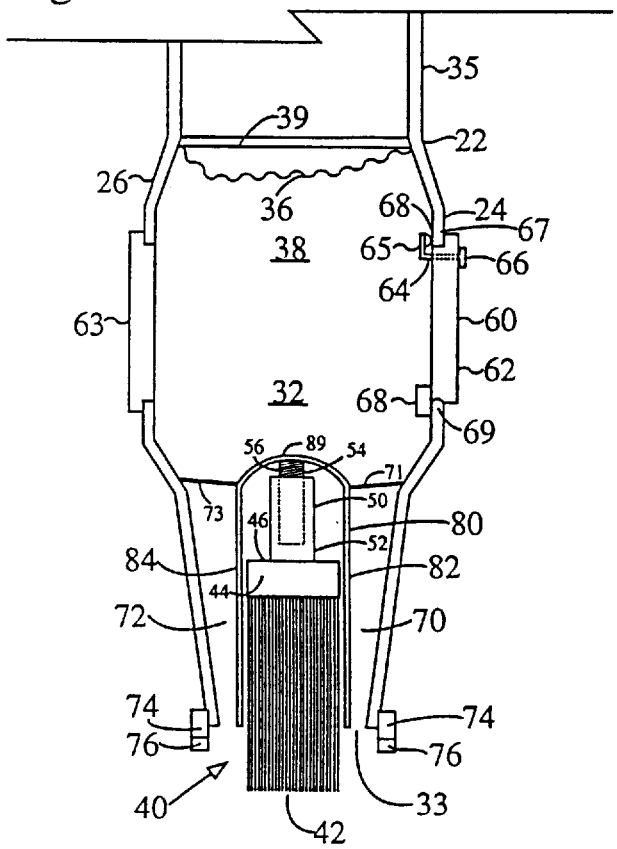
FIG. 43 is an enlarged front elevational view similar to FIG. 41, of the vacuum assisted broom as shown in FIG. 38.
Figure 44:
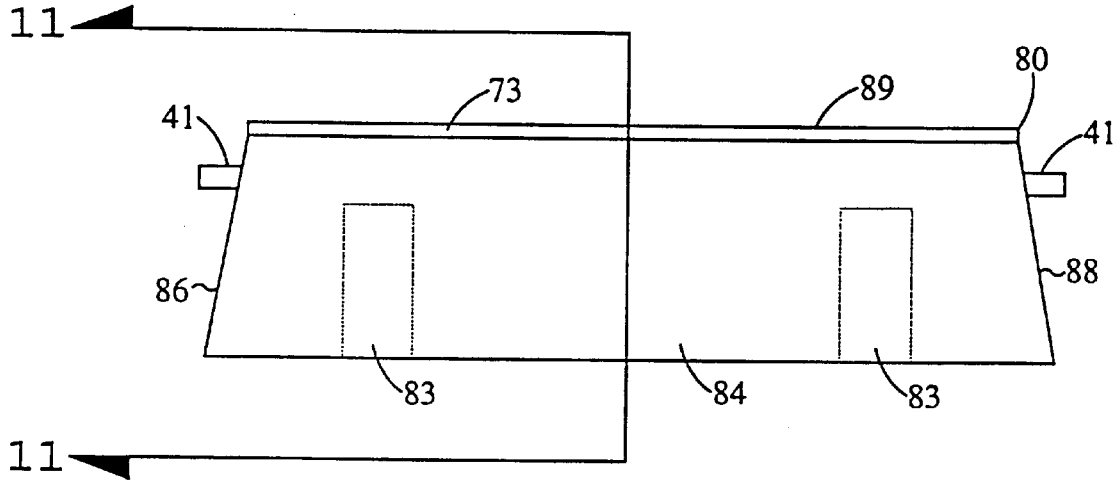
FIG. 44 is a sectional side elevational view along section line 10—10, of the head portion of the vacuum assisted broom as shown in FIG. 43.
Figure 45:
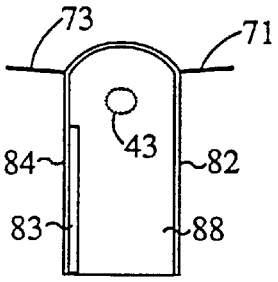
FIG. 45 is a front elevational view of the encasement member within the head portion.
Figure 46:
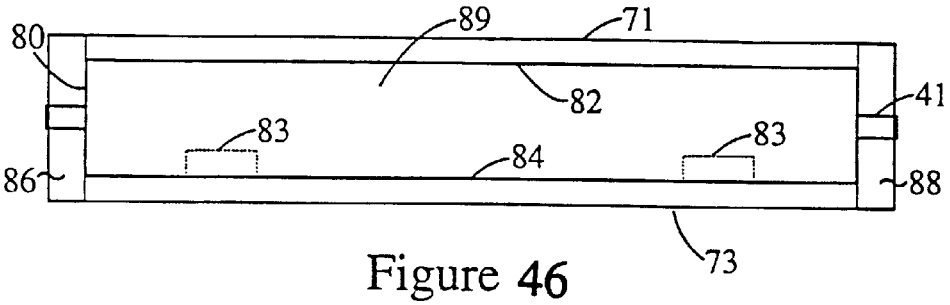
FIG. 46 is a top view of the encasement member of FIG. 45.
Figure 47:
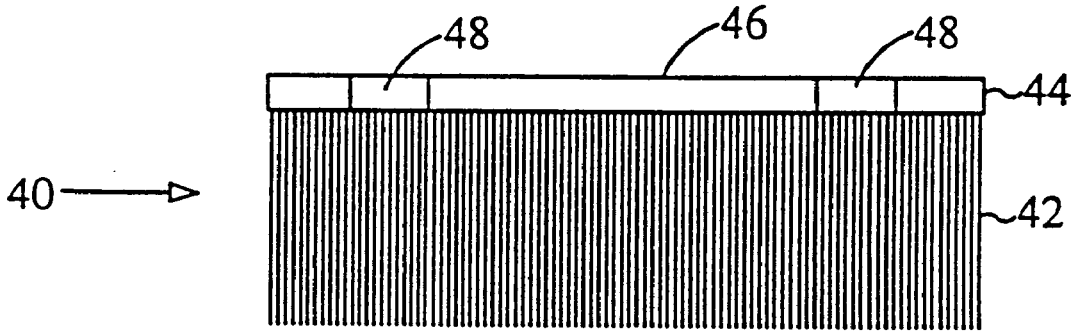
FIG. 47 is a front elevational view of the sweeping member of the vacuum assisted broom of the present invention.
Figure 48:
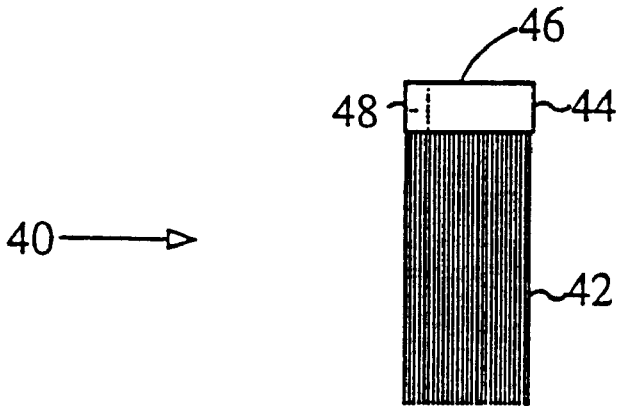
FIG. 48 is an end elevational view of the sweeping member shown in FIG. 47.
Figure 49:
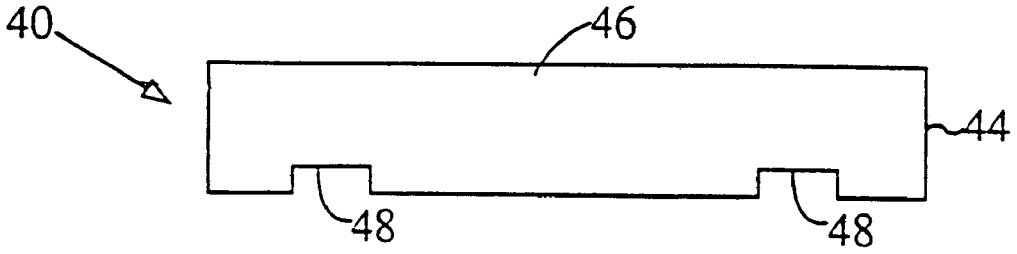
FIG. 49 is a top plan view of the sweeping member shown in FIG. 47.
Figure 50:
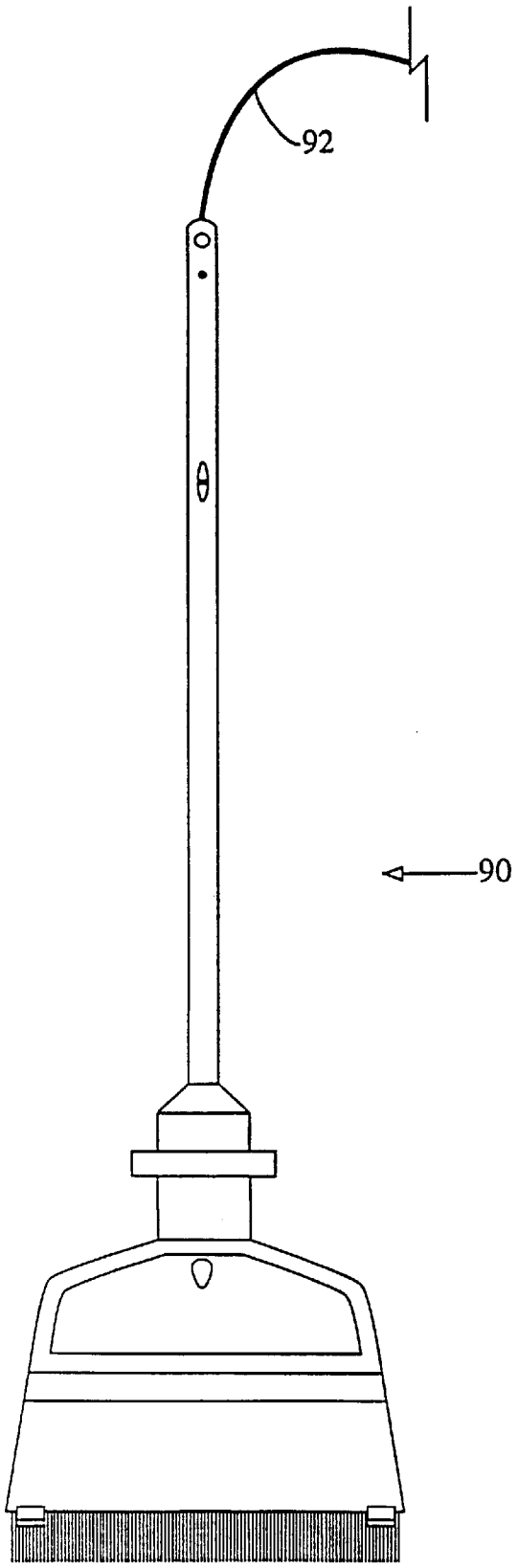
FIG. 50 is a front elevational view of a household current powered alternative embodiment of the vacuum assisted broom of the present invention.
Figure 51:
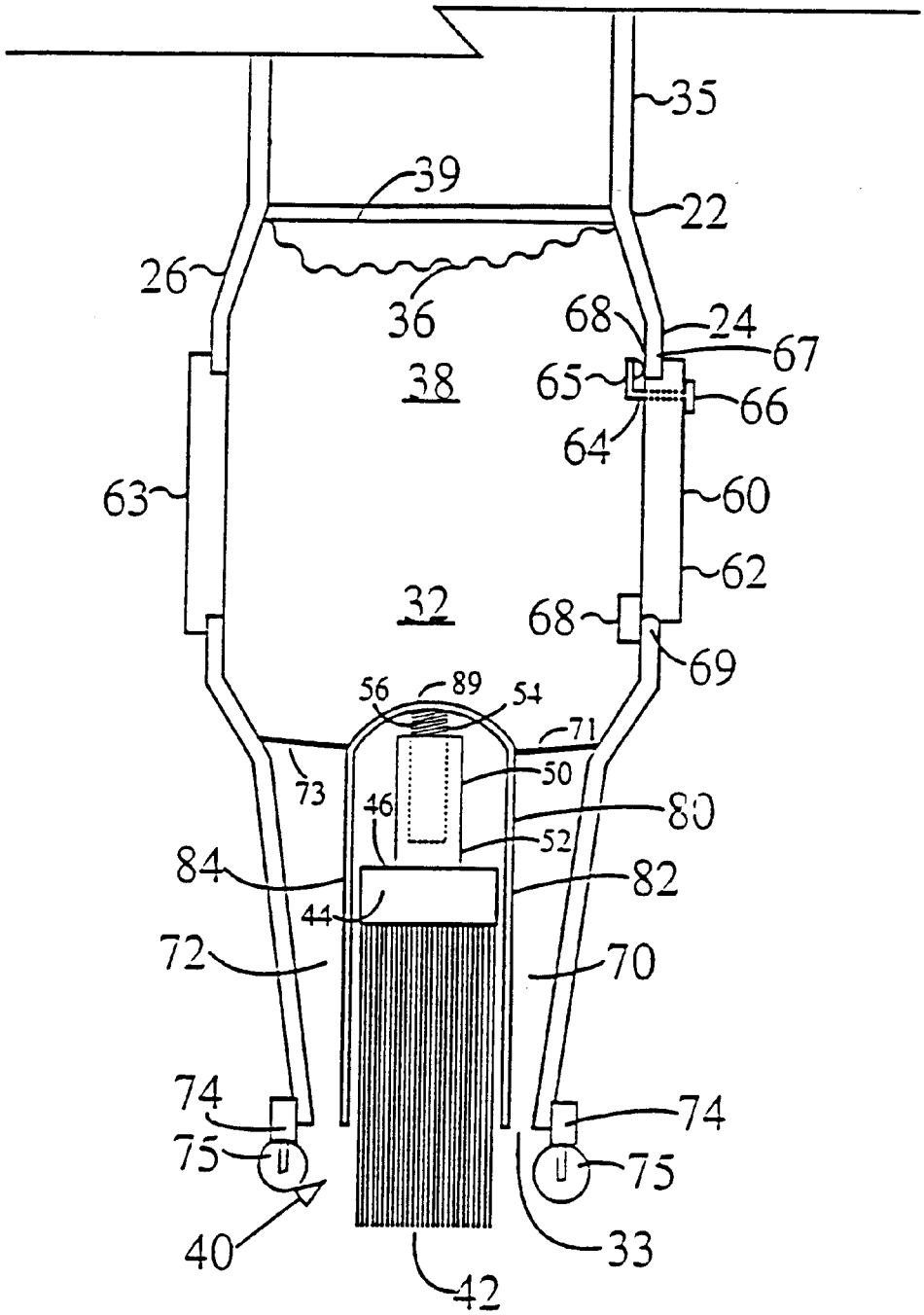
FIG. 51 is a sectional side elevational view of a portion of another alternative embodiment of the vacuum assisted broom of the present invention.

The fixed type of brush assembly 88 as seen in FIGS. 26, 27, 28, 29, 30 and 31 has two holes 50 in its rigid body 82 that transverse the said rigid body. As seen in FIG. 34 the said holes 50 house two long pins 56 with threaded ends. The pins 56 are also inserted through the opposite holes 83 located on each side of the encasement 80, as seen in FIG. 32, against which they are fastened with nuts 77 as seen in FIG. 34. In the fixed type of brush assembly 88 the sealing action of suction chamber 96 or 98 is performed by the bristles 81 which bend and press against the bottom of the brush encasement 80 in the direction opposite to the sweeping motion 52 as seen in FIG. 30. In the fixed type of brush assembly 88 the principle of operation is the same as was previously indicated for the movable type of brush assembly 89.

Reference will now be made to FIGS. 35 to 51, which show the vacuum assisted broom 20 made in accordance with the currently preferred embodiment of the present invention, and also show separately various components thereof. The vacuum assisted broom 20 is used from sweeping a sweepable surface, such as a floor or the like, in order to sweep debris such as dust and dirt to a localized area and to subsequently vacuum up this debris. A sweeping member 40 in the form of a plurality of broom bristles 42 is adapted for bi-directional sweeping surface such as a floor or the like. The broom bristles 42 may be of any conventional type, or may even be of a specialized type if desired.

A housing member 22 having interconnected walls—front walls 24, rear walls 26, and side walls 28 and 30, a closed top portion 31, and a first opening 33 at the bottom thereof—together defining a hollow interior 32, is shaped and dimensioned to generally surround and thereby house the sweeping member 40, a filter member 36, and a debris collection compartment 38 for collecting the debris that is vacuumed up by the vacuum assisted broom 20 and is filtered out by the filter member 36. A suction means in the form of an electric motor 34 and suitable fan 37 resides within its won generally cylindrical enclosure 35 that extends upwardly from the closed top portion 31 of the housing member 22.

Extending upwardly from the generally cylindrical enclosure 35 is an elongate handle member 23, which is preferably threadibly engaged on the generally cylindrical enclosure 35 at the top thereof. The elongate handler member 23 is thereby removably attached to the enclosure 35, for the purposes of shipping and also to permit interchangeable handle members of different lengths. A short handle member suitable to allow manipulation of the vacuum assisted broom 20 by way of one hand only may be desirably in certain instances. An electrical switch 25 for selectively activating the electric motor 34 is located at a convenient upper portion of the elongate handle member 23. An indicator light 27 may be used to indicate that electrical power is switched on or that the batteries 29 are being charged. In order to provide power for recharging the batteries 29, a low voltage electrical adapter (not shown) is used. The electrical adaptor plugs into a conventional 110 VAC electrical outlet and the plug at the end of the electrical cord plugs into an electrical connector 31 on the handle member 23.

The sweeping member 40 comprises a plurality of bristles 42 conventionally mounted within a horizontally displaced head portion 44. The sweeping member 40 is slidably mounted within a confinement member 80 for vertical sliding movement between a first extended position as shown in FIG. 1, and a second retracted position as shown in FIG. 4. The confinement member 80 comprises a front wall 82, a rear wall 84, side walls 86 and 88, and a top portion 89 that closes off the confinement member 80 so as to preclude the passage of debris throughout. The head portion 44 of the sweeping member 40 has a pair of slots 48 therein, which slots 48 co-operating interact with a corresponding pair of vertically disposed rails 83 on the interior of the confinement member 80.

In the first extended position of the sweeping member 40, the broom bristles 42 extend outwardly from the housing member 22 through the first opening 33 by perhaps about 1 inch to 3 inches so as to form a conventional sweeping broom. In the second retracted position, the broom bristles 42 extend outwardly from the housing member 22 through the first opening 33 by about only ½ inch, thus forming a stiff-bristled brush-like broom suitable for hard sweeping. The remaining upper portion of the broom bristles 42 are physically confined within confinement member 80 such that the upper portion of the broom bristles 42 are physically confined therein are precluded from moving mainly by the first wall 82 and the second wall 84. In this manner, the confinement member 80 limits the lateral motion of the bristles during sweeping, thus permitting a substantially more stiff sweeping action of the bristles, as compared to when in their fully extended position. This more stiff sweeping action is very useful when sweeping some types of debris such as tracked in mud that has now dried and might have partially stuck to the floor. Further, having the sweeping member 40 in its first extended position allows the first opening 33 to be close to the surface being swept for the purpose of vacuuming.

Mounted on the top of the head portion 44 of the sweeping member 40, as to be operatively connected between the sweeping member 40 and the housing member 22, are a pair of mechanical latch devised 50. Each mechanical latch device 50 comprises a lower portion 52 securely connected to the head potion 44 of the sweeping member 40 and an upper portion 54 securely connected to the top portion of the confinement member 80. The upper portion 54 of the mechanical latch device 50 is slidably mounted within the lower portion 52. In this manner, the two mechanical latch devices 50 act as track members to operatively retain the sweeping member 40 for vertical sliding movement within the confinement member 80 between a first extended position and a second retracted position. Further, each of the mechanical latch devices 50 have internal releasable latches (not shown) that cause the sweeping member 40 to be releasably latched in its second retracted position, upon reaching that second retracted position. In actuality, due to the inherent nature of the mechanical latch systems—that it to say that mechanical hysteresis that is typically found in conventional mechanical latch systems of this type—the sweeping member 40 must be moved slightly beyond the actual latching position in order for latching to occur. The sweeping member 40 then moves very slightly in the opposite direction back towards the first extended position to its second retracted position by way of a spring member 56 within each of the mechanical latch devices 50. The spring members 56 also bias the sweeping member 40 towards its first extended position so as to help keep the sweeping member 40 in that first extended position during normal sweeping. The sweeping member 40 may be moved from its first extended position to its second retracted position by means of increased upward force on the sweeping member 40. This increased upward force on the sweeping member 40 is usually caused by pushing the vacuum assisted broom 20 downwardly against a floor which holding onto the handle member 23.

The housing member 22 also has a removable and replaceable door member 60 on the front thereof. This door member 60 allows access to the debris collection compartment 38 so as to permit emptying debris therefrom. Preferably, the door member 60 has a window 62 therein to permit visual monitoring of the amount of debris in the debris collection compartment 38. A release mechanism 64 is mounted on the door member 60 so as to engage a first lip portion 67 of the housing member 22 in interfering relation therewith. The release handle 66 is pivotable so as to permit a catch arm 65 of the release mechanism 64 to move into an out of engagement with the first lip portion 67 of the housing member 22. The bottom end of the door member 60 has a pair of flanges 68 thereon that fit behind a second lip portion 69 of the housing member 22 in interfering relation therewith so as to retain the door member 60 in place on the housing member 22. There may also be a fixed window 63 on the opposite other side of the housing member 22.

The confinement member 80 is pivotably mounted with respect to the housing member 22 by way of a pair of mounting pins 41, one at each opposite end of the confinement member 80, which mounting pins 41 engage co-operating apertures 43 in the housing member 22. A plastic annular spacer 45 surrounds a central portion of each of the mounting pins 41 so as to preclude the confinement member 80 from moving side-to-side within the housing member 22 and also to preclude debris such as dust and dirt from reaching the mounting pins 41 and apertures 43.

As stated earlier, a suction means in the form of the electric motor 34 and fan 37 are mounted on the closed top portion 31 of the housing member 22 and are operatively connected thereto by way of a second opening 39 in the top portion 31 of the housing member 22. In this matter, the suction means is in fluid communication with the hollow interior 32 of the housing member 22 so as to thereby be able to create a partial vacuum at the first opening 33 of the housing member 22 when the electric motor 34 is energized. In the preferred embodiment, the electric motor 34 is powered by batteries 29 retained within the elongate handle member 23.

An electrical switch 25 on the elongate handle member 23 is used to manually turn on and off the automatic electrical function of the vacuum assisted broom 20, as will now be detailed. The suction means is automatically actuatable by way of the change in positioning of the sweeping member 40 between its first extended position and its second retracted position. A switch means in the form of an electrical switch 51 securely attached to the top surface 46 of the head portion 44. The electrical switch 51 is closed by way of movement of the sweeping member 40 upwardly until the handle portion 53 of the electrical switch 51 contacts a protruding actuation member 81 of the top portion 89 of the confinement member 80, when the sweeping member 40 reaches its second retracted position. When the electrical switch 51 becomes closed, the electric motor 34 is energized, thus causing a partial vacuum at the first opening 33 of the housing member 22—in other words, the vacuum is turned on. In this matter, the electrical switch 51 is operatively mounted between the housing member 22 and the sweeping member 40.

The vacuum assisted broom 20 further comprises a selectively closeable front inlet 70 located between the sweeping member 40 and the front wall 24 of the housing member 22, and a selectively closeable rear inlet 72 located between the sweeping member 40 and the rear wall 26 of the housing member 22. The sweeping member 40 is operatively mounted by way of the aforesaid mounting pins 41 for movement between a forward position and a rearward position. In the forward position the front inlet 70 is substantially closed so as to preclude the passage of air and debris therethrough and the rear inlet 72 is fully open so as to permit the passage of air and debris therethrough. In the rearward position, the rear inlet 72 is substantially closed so as to preclude the passage of air and debris therethrough, and the front inlet 70 is fully open so as to permit the passage of air and debris therethough. Located at the top of each of the front and rear inlets 70 and 72 are respective rubber seals 71 and 73 respectively. These rubber seals 71 and 73 can deflect upwardly so that the dust and debris can enter the debris collection compartment 38, but subsequently preclude the dust and debris from exiting the debris collection compartment 38 through the front and rear inlets 70 and 72.

Four leg members 74 depend from the bottom edge 21 of the housing member 22. These leg members 74 are positioned so as to contact a sweepable surface when the sweeping member 40 is into second retracted position. Further, these leg members 74 are shaped and dimensioned to preclude the bottom edge 21 of the housing member 22 from contacting the sweepable surface, thus always maintaining a gap between the sweepable surface and the bottom edge 21 of the housing member 22. This gap is suitable for allowing the passage of air and debris therethrough. In this manner, since there is always a suitable gap between the housing member 22 and the sweepable surface, the path that air and debris must travel along to reach the first opening 33 is never blocked.

In the preferred embodiment, the leg members 74 have a small felt pads 76 on the ends thereof to preclude scratching of a floor. Alternatively, a small wheel member 75 may be rotatably attached to each of the leg members 74 so as to extend below each respective leg member 74, to thereby be adapted for rolling contact with the floor, as can best be seen in FIG. 17.

In use, the vacuum assisted broom 20 is used to sweep debris such as dust and dirt on a sweepable surface such as a floor, to a localize area, with the sweeping member 40 in its fully extended position. The vacuum assisted broom 20 is then pushed downwardly against the floor being swept such that the sweeping member 40 is moved upwardly into the housing member 22 from its first extended position to its second retracted position. As described previously, at the second retracted position, the electrical switch 51 on the head portion 44 of the sweeping member 40 moves such that the handle member 53 of the electrical switch 51 contacts the protruding member 81 on the top portion 89 of the confinement member 80 so as to electrically close the electrical switch 51 and thereby energize the electric motor 34. In this manner, the suction means is selectively actuated by way of the change in positioning of the sweeping member 40 between its first extended position and second retracted position. The mechanical latch devices 50, which are operatively connected between the housing member 22 and the head portion 44 of the sweeping member 40, as aforedescribed, retain the sweeping member 40 in its second retracted position. Debris may then be vacuumed up through the first opening 33 in the housing member 22, passing through one or both of the front inlet 70 and rear inlet 72, and ultimately into the debris collection compartment 38. Once vacuuming is finished, the vacuum assisted broom 20 is again pushed downwardly against the floor so as to cause the mechanical latch devices 50 to release and permit the spring members 56 to return the sweeping member 40 to its fully extended position. In this manner, the sweeping member 40 is releasably latchable in its second retracted position.

In an alternative embodiment, an electrical switch means may be operatively mounted between the housing member 22 and the leg members 74 such that when the vacuum assisted broom 20 is pressed downwardly against a floor and the sweeping member 40 is thereby moved to its second retracted position, and the leg members 74 contact the floor, the electrical switch is closed so as to energize the electric motor 34, to thereby selectively actuate the suction means.

In another alternative embodiment of the present invention, it is contemplated that a broom would have a sweeping member adapted for bi-directional sweeping of a surface, mounted on a housing member for movement between a first extended position and a second extended position. The housing member having interconnected front, rear, and side walls defining a hollow interior, is shaped and dimensioned to generally surround at least the top portion of the sweeping member. The sweeping member is operatively mounted on the housing member such that the bristles of the sweeping member extend outwardly therefrom through a first opening in the housing member. A handle member is securely attached to the housing member and extends upwardly therefrom.

In the first extended position, the bristles extend outward to their full extent from the first opening of the housing member to form a conventional sweeping broom, thereby permitting sweeping of a floor using a broom-like sweeping action. In the second retracted position, the sweeping member is substantially retracted into the housing member such that only a small end portion of the bristles extend outwardly therefrom through the first opening by only about ½ inch, thus forming a stiff-bristled brush-like broom. The remaining upper portion of the broom bristles are physically confined within a confinement member such that the upper portion of the broom bristles confined therein can move no more than very slightly. In this manner, the confinement member limits the lateral motion of the bristles during sweeping, thus permitting a substantially more stiff sweeping action of the bristles, as compared to when in their fully extended position. This more stiff sweeping action is very useful when sweeping some types of debris such as mud that has dried on a floor.

Figure 17:
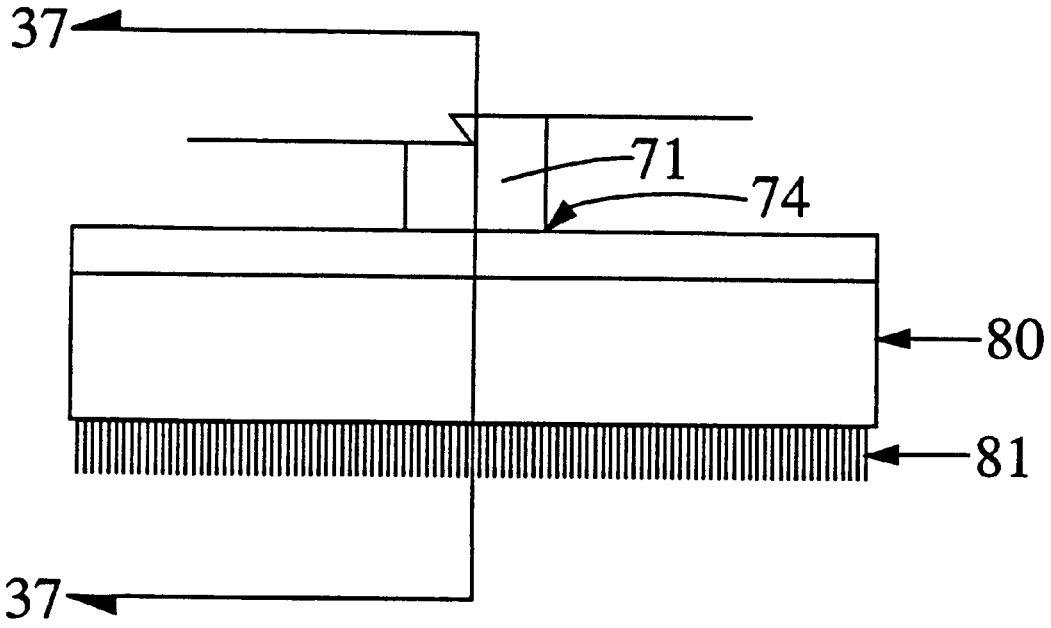
FIG. 17 is a front view of the movable floor brush.
Figure 18:
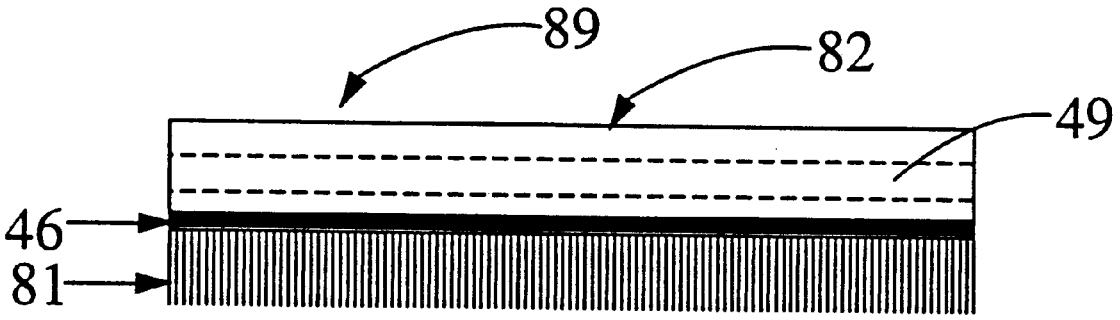
FIG. 18 is a front view of the movable brush in FIG. 17 showing the rubber sealing strip attached.
Figure 19:
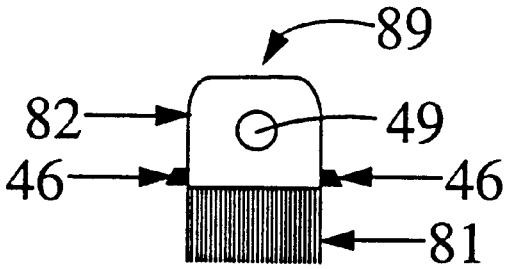
FIG. 19 is a side view of FIG. 18.

In another alternative embodiment, as shown in FIG. 17, it is contemplated that the vacuum assisted broom 90 of the present invention could be plugged into a conventional 110 VAC outlet by means of an electrical cord 92, so as to be directly powered by hydro-electric current.

In yet another alternative embodiment, it is envisioned that the suction means may be operatively mounted with respect to the housing member by way of an elongate hose in fluid communication with the housing member through the elongate broom handle. This embodiment of the vacuum assisted broom could be operatively connected to a central vacuuming system, which would provide for a very high amount of vacuuming power, but which would also provide a broom to perform conventional sweeping.

Other modifications and alterations may be used in the design and manufacture of the mechanical security apparatus of the present invention without departing from the spirit and scope of the accompanying claims.

What is claimed is:

1. A vacuum assisted broom for sweeping a sweepable surface, said broom comprising:

(a) a housing member having interconnected front, rear and side walls defining a hollow interior and being shaped and dimensioned to generally surround at least the top portion of a sweeping member;

(b) a handle member securely attached to said housing member and extending upwardly therefrom, wherein the handle member is an elongate broom handle;

(c) a sweeping member mounted within said housing member so as to depend therefrom through a first opening in said housing member, said sweeping member extending outwardly a selected distance from said first opening in said housing member which permits the sweeping of said sweepable surface using a broom-like sweeping action, and which places the first opening in said housing member in sufficiently close proximity to said sweepable surface so as to permit vacuuming of debris from said sweepable surface; and (d) selectively actuatable suction means operatively connected to said housing member by way of a second opening in said housing member such that said hollow interior is in fluid communication with said suction means so as to thereby create a partial vacuum at said first opening upon actuation.

2. The vacuum assisted broom of claim 1, wherein said sweeping member comprises a plurality of broom bristles.

3. The vacuum assisted broom of claim 2, further comprising a plurality of leg members depending from the bottom of said housing member, said leg members positioned so as to contact said sweepable surface and shaped and dimensioned to preclude the bottom of said housing member from contacting said sweepable surface, thus creating a gap between said sweepable surface and the bottom of said housing member, said gap suitable for allowing the passage of debris therethrough.

4. The vacuum assisted broom of claim 3, wherein said leg members depend from the bottom area of said front and rear walls of said housing member.

5. The vacuum assisted broom of claim 4, wherein each leg member has a wheel member rotatably attached thereto so as to extend below said leg member, to thereby be adapted for rolling contact with said sweepable surface.

6. The vacuum assisted broom of claim 1, further comprising a selectively closable front inlet located between said sweeping member and the front wall of said housing member and a selectively closable rear inlet located between said sweeping member and the rear wall of said housing member, with said sweeping member operatively mounted for movement between a forward position whereat said rear inlet is fully open so as to permit the passage of air and debris therethrough and said front inlet is substantially closed so as to preclude the passage of air and debris therethrough, and rearward position whereat said front inlet is fully open so as to permit the passage of air and debris therethough and said rear inlet is substantially closed so as to preclude the passage of air and debris therethrough.

7. A vacuum assisted broom for sweeping a sweepable surface, said broom comprising:

(a) a housing member having interconnected front, rear and side walls defining a hollow interior and being shaped and dimensioned to generally surround at least the top portion of a sweeping member;

(b) a handle member securely attached to said housing member and extending upwardly therefrom, wherein the handle member is an elongate broom handle;

(c) a sweeping member mounted within said housing member so as to depend therefrom, said sweeping member extending outwardly a selected distance from a first opening in said housing member which permits the sweeping of said sweepable surface using a broom-like sweeping action, and which places the first opening in said housing member in sufficiently close proximity to said sweepable surface so as to permit vacuuming of debris from said sweepable surface; and (d) selectively actuatable suction means operatively connected to said housing member by way of a second opening in said housing member such that said hollow interior is in fluid communication with said suction means so as to thereby create a partial vacuum at said first opening upon actuation.

* * * * *